US010545439B2

(12) United States Patent
Matsumoto et al.

(10) Patent No.: US 10,545,439 B2
(45) Date of Patent: Jan. 28, 2020

(54) FIXED MEMBER AND HEAT FIXING APPARATUS

(71) Applicant: CANON KABUSHIKI KAISHA, Tokyo (JP)

(72) Inventors: Mamo Matsumoto, Hiratsuka (JP); Katsuhisa Matsunaka, Inagi (JP); Matsutaka Maeda, Kawasaki (JP); Yasuharu Notoya, Tokyo (JP); Yuji Kitano, Tokyo (JP); Makoto Souma, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/421,676

(22) Filed: May 24, 2019

(65) Prior Publication Data

US 2019/0377285 A1 Dec. 12, 2019

(30) Foreign Application Priority Data

Jun. 7, 2018 (JP) ..... 2018-109688

(51) Int. Cl.
*G03G 15/20* (2006.01)

(52) U.S. Cl.
CPC ..... *G03G 15/206* (2013.01); *G03G 15/2064* (2013.01); *G03G 15/2057* (2013.01)

(58) Field of Classification Search
CPC ..... G03G 15/206; G03G 15/2057; G03G 2215/2048; G03G 2215/2051; G03G 2215/2054
See application file for complete search history.

(56) References Cited

U.S. PATENT DOCUMENTS

| | | | |
|---|---|---|---|
| 8,401,450 | B2 | 3/2013 | Sekihara et al. |
| 9,037,062 | B2 | 5/2015 | Matsumoto et al. |
| 9,086,664 | B2 | 7/2015 | Matsunaka et al. |
| 9,134,663 | B2 | 9/2015 | Matsunaka et al. |
| 9,134,664 | B2 | 9/2015 | Miura et al. |
| 9,195,190 | B2 | 11/2015 | Honke et al. |
| 9,367,009 | B2 | 6/2016 | Akiyama et al. |

FOREIGN PATENT DOCUMENTS

| | | | |
|---|---|---|---|
| JP | 2009-288380 | A | 12/2009 |
| JP | 2009-288381 | A | 12/2009 |
| JP | 2010-91717 | A | 4/2010 |
| JP | 2013-130712 | A | 7/2013 |

*Primary Examiner* — Erika J Villaluna

(74) *Attorney, Agent, or Firm* — Venable LLP

(57) ABSTRACT

The present disclosure provides a fixing member that has a substrate, and a single layer of an elastic layer on the substrate, the elastic layer having a thickness of 100 μm or more, and containing a binder and a filler, wherein the elastic layer contains the filler in a content of 30% by volume or more to 60% by volume or less based on the total volume of the elastic layer, and wherein, when a surface of the elastic layer facing to the substrate is defined as a first surface, and a surface of the elastic layer opposed to the first surface is defined as a second surface, an average value of ratios of an element derived from the filler is 0.0 atomic % or more to 6.0 atomic % or less in a region having a thickness of 6 μm, from the first surface toward the second surface.

14 Claims, 10 Drawing Sheets

FIXED MEMBER AND HEAT FIXING APPARATUS

BACKGROUND

The present invention relates to a fixing member that is used as a heating member or a pressing member in a heat fixing apparatus of an electrophotographic image forming apparatus, and to a heat fixing apparatus.

DESCRIPTION OF THE RELATED ART

In a heat fixing apparatus of an electrophotographic image forming apparatus, a pressure contact part includes a heating member and a pressing member which is arranged so as to face the heating member. When an object to be recorded which retains an unfixed toner image is introduced to the pressure contact part, the unfixed toner is heated and pressed, the toner is melted, and the image is fixed on the object to be recorded. The heating member is a member with which the unfixed toner image on the object to be recorded comes in contact, and the pressing member is a member which is arranged so as to face the heating member. As for a shape of the fixing member, there is a rotatable fixing member which has a roller shape or an endless belt shape. Such a fixing member may comprise a substrate made of metal or heat resistant resin, and an elastic layer which contains, for example, a rubber such as a crosslinked silicone rubber, and a filler in this order in the thickness direction of the fixing member.

Japanese Patent Application Laid-Open No. 2013-130712 discloses a fixing apparatus that has a heater, a cylindrical film which is heated by the heater, and a pressing member which comes in contact with the film to form a nip. In addition, it is described that the film has a base layer formed from a metal, and an elastic layer formed from a rubber which contains at least one of metal silicon, silicon carbide and zinc oxide as a thermally conductive filler.

SUMMARY

One aspect of the present disclosure is directed to providing a fixing member that can perform stable heat fixing even in long-term use.

Another aspect of the present disclosure is directed to providing a heat fixing apparatus that can stably form a high quality electrophotographic image.

According to one aspect of the present disclosure, a fixing member is provided that has a substrate, and a single layer of an elastic layer on the substrate, the elastic layer having a thickness of 100 μm or more, and containing a binder and a filler, wherein the elastic layer contains the filler in a content of 30% by volume or more to 60% by volume or less based on the total volume of the elastic layer, and wherein, when a surface of the elastic layer facing to the substrate is defined as a first surface, and a surface of the elastic layer opposed to the first surface is defined as a second surface, an average value of a ratio of an element derived from the filler is 0.0 atomic % or more to 6.0 atomic % or less in a region having a thickness of 6 μm, from the first surface toward the second surface.

In addition, according to another aspect of the present disclosure, a heat fixing apparatus is provided that has a heating member and a pressing member which is arranged so as to face the heating member, wherein the heating member is the above described fixing member.

Further features of the present disclosure will become apparent from the following description of exemplary embodiments with reference to the attached drawings.

BRIEF DESCRIPTION OF THE DRAWINGS

FIG. 8A-2 is a view for describing a state of an elastic layer of the fixing member at the time when a recording medium is conveyed, and is a view corresponding to the fixing member of the present disclosure.

FIG. 8B-1 is a view for describing a state of an elastic layer of the fixing member at the time when a recording medium is conveyed, and is a view corresponding to a conventional fixing member.

FIG. 8B-2 is a view for describing a state of an elastic layer of the fixing member at the time when a recording medium is conveyed, and is a view corresponding to the conventional fixing member.

DESCRIPTION OF THE EMBODIMENTS

Preferred embodiments of the present disclosure will now be described in detail in accordance with the accompanying drawings.

A fixing member which is used as a heating member in a heat fixing apparatus is required to efficiently transmit the heat of a heated substrate to an outer surface. Because of this, as in the film according to Japanese Patent Application Laid-Open No. 2013-130712, the elastic layer in the fixing member is usually made into a single layer, and also contains a thermally conductive filler.

However, according to the investigation of the present inventors, there has been a case where a scratch is formed on the surface on an elastic layer side of the substrate, when the fixing member provided with the elastic layer containing the thermally conductive filler is used for a long period of time. There has been the case where such a scratch causes a rupture of the substrate when the fixing member has been used for a long period of time.

<Fixing Member>

The fixing member according to one aspect of the present disclosure can be structured to be, for example, a rotatable member having a shape such as a roller shape and an endless belt shape (hereinafter, also referred to as a fixing roller and a fixing belt, respectively).

Figure 1A:
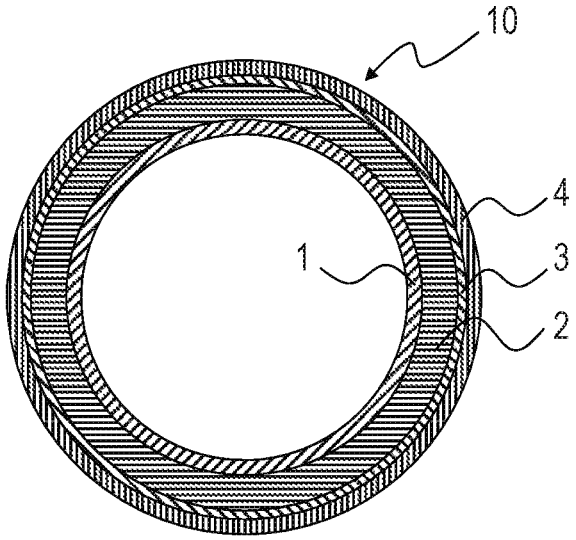
FIG. 1A is a schematic cross-sectional view of a fixing member having an endless belt shape according to one embodiment of the present disclosure, and is a cross-sectional view of the fixing member in the circumferential direction.
Figure 1B:
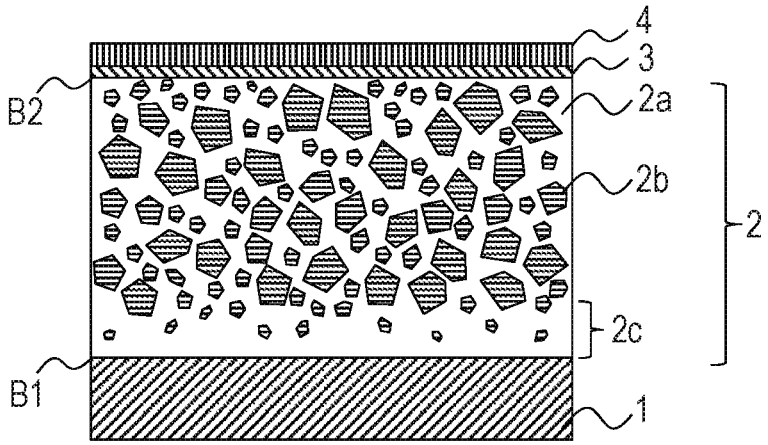
FIG. 1B is a partially enlarged view of a cross section of the fixing member illustrated in FIG. 1A.

FIG. 1A is a schematic cross-sectional view of the fixing belt in the circumferential direction, and FIG. 1B is an enlarged view of one part of a cross section of the fixing belt illustrated in FIG. 1A.

The fixing belt 10 has a substrate (base material) 1 with an endless belt shape, and an elastic layer 2 which is arranged on an outer circumferential surface of the substrate. In addition, in the fixing belt 10, a releasing layer 4 which is an option is fixed on the outer circumferential surface of the elastic layer 2, by an adhesive layer 3.

The elastic layer 2 consists of a single layer, and includes a binder 2*a* and a filler 2*b* which is dispersed in the binder 2*a*. The content of the filler 2*b* in the elastic layer 2 is 30% by volume or more to 60% by volume or less based on the total volume of the elastic layer 2.

The elastic layer has a thickness of 100 μm or more. In addition, an average value of ratios of an element derived from the filler 2*b* is 0.0 atomic % or more to 6.0 atomic % or less in a region having a thickness of 6 μm of the elastic layer 2, from a first surface B1 on a side facing the substrate of the elastic layer toward a second surface B2 on an opposite side to the first surface B1. In other words, the content of the filler 2*b* which the region contains is smaller than the content of the filler 2*b* which the elastic layer 2 contains.

Each member which constitutes the fixing member according to one aspect of the present disclosure will be described below in detail.

(1) Substrate

A material of the substrate is not limited in particular, and materials known in a field of fixing members can be appropriately used. Examples of the material which constitutes the substrate include: metals such as aluminum, iron, nickel and copper; alloys such as stainless steel; and resins such as polyimide.

Here, when the heat fixing apparatus is a heat fixing apparatus that heats the substrate by an induction heating method as a heating unit of the fixing member, the substrate is formed from a material which can be heated by induction heating, as is at least one metal selected from the group consisting of nickel, copper, iron and aluminum. Among the metals, in particular, an alloy containing nickel or iron as a main component is preferably used, from the viewpoint of heat generation efficiency. A main component means a component which is contained most, among the components which constitute an object (here, substrate).

A shape of the substrate can be appropriately selected according to the shape of the fixing member, and can be determined to be various shapes such as an endless belt shape, a hollow cylindrical shape, a solid cylindrical shape and a film shape.

In the case of the fixing belt, it is preferable that a thickness of the substrate be, for example, 15 to 80 μm. By setting the thickness of the substrate within the above described range, the substrate can achieve both of strength and flexibility at a high level.

In addition, on the surface on an opposite side to the side facing the elastic layer of the substrate, a layer can be also provided, for example, which is for preventing the inner circumferential surface of the fixing belt from being abraded when the inner circumferential surface of the fixing belt contacts other members, or is for improving the slidability with other members.

The surface on the side facing the elastic layer of the substrate may be subjected to surface treatment so as to impart functions such as adhesiveness with the elastic layer. Examples of the surface treatment include physical treatments such as blasting treatment, lapping treatment and polishing, and chemical treatments such as oxidation treatment, coupling agent treatment and primer treatment. Also, the physical treatment and the chemical treatment may be concomitantly used.

In particular, when the elastic layer is an elastic layer which contains a crosslinked silicone rubber as a binder, it is preferable to treat an outer surface of the substrate with a primer, in order to improve adhesiveness between the substrate and the elastic layer. Usable examples of the primer include a primer in a paint state in which an additive is appropriately blended and dispersed in an organic solvent. Such a primer is commercially available. Examples of the above described additive include a silane coupling agent, a silicone polymer, a methyl siloxane hydride, an alkoxysilane, a catalyst for promoting reaction such as hydrolysis, condensation or addition, and a coloring agent such as red-ocher rouge. The primer treatment is performed by applying the primer to the outer surface of the substrate 1 followed by performing a process of drying and baking.

The primer can be appropriately selected according to, for example, a material of the substrate 1, a type of the elastic layer 2, a reaction form at the time of crosslinking, and the like. For example, when the material constituting the elastic layer 2 contains a large amount of unsaturated aliphatic groups, a material containing a hydrosilyl group is preferably used as a primer so as to impart the adhesiveness by a reaction with the unsaturated aliphatic group. In addition, when the material constituting the elastic layer 2 contains a large amount of hydrosilyl groups, conversely, a material containing the unsaturated aliphatic group is preferably used as the primer. In addition to the above, a material containing an alkoxy group or the like is also used as the primer. The primer can be appropriately selected according to the types of the substrate 1 and the elastic layer 2 which are adherends.

(2) Elastic Layer

The elastic layer is a layer for imparting flexibility to the fixing member so as to secure a fixing nip in the heat fixing apparatus. When the fixing member is used as a heating member which comes in contact with a toner on paper, the elastic layer also functions as a layer for providing flexibility such that the surface of the fixing member can conform to the unevenness of the paper. The elastic layer contains a binder and a filler.

From the viewpoint that the elastic layer exhibits the above described function, it is preferable for the elastic layer to contain a cured product of silicone rubber containing a filler, and more preferable to contain a cured product of an addition-curable type silicone rubber composition. The silicone rubber composition can contain, for example, the filler and the addition-curable type liquid silicone rubber.

The elastic layer consists of a single layer. The elastic layer which is the single layer can thereby reduce a manufacturing cost compared to an elastic layer which consists of a plurality of layers.

In addition, the elastic layer has a thickness of 100 μm or more. Furthermore, in the case of the fixing belt, the thickness of the elastic layer is more preferably 200 to 600 μm. The elastic layer which has a thickness of 100 μm or more can thereby form a wider width nip in the heat fixing apparatus.

(2-1) Binder

The binder plays a function of exhibiting elasticity in the elastic layer. It is preferable that the binder contain a silicone rubber, from the viewpoint that the binder exhibits the above described function of the elastic layer. The silicone rubber has high heat resistance which can keep the flexibility, even in an environment which becomes a high temperature of approximately 240° C. in a non-sheet-passing area, and is preferable. As the silicone rubber, for example, a cured product of the addition-curable type liquid silicone rubber (hereinafter also referred to as "cured silicone rubber") which will be described later, can be used.

(2-1-1) Addition-Curable Type Liquid Silicone Rubber

The addition-curable type liquid silicone rubber usually contains the following components (a) to (c):

(A) organopolysiloxane having an unsaturated aliphatic group;

(B) organopolysiloxane having active hydrogen bonded to silicon; and (C) a catalyst.

Each component will be described below.

(2-1-2) Component (a)

The organopolysiloxane having an unsaturated aliphatic group is organopolysiloxane having an unsaturated aliphatic group such as a vinyl group, and includes, for example, organopolysiloxanes which are represented by the following structural formula (1) and structural formula (2), respectively.

Structural formula (1)

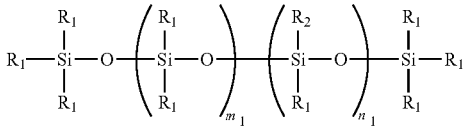

In structural formula (1), $m_1$ represents an integer of 0 or larger, and $n_1$ represents an integer of 3 or larger. In structural formula (1), $R_1$ each independently represents a monovalent unsubstituted or substituted hydrocarbon group which does not contain an unsaturated aliphatic group, but, at least one of $R_1$ represents a methyl group; and $R_2$ each independently represents an unsaturated aliphatic group.

Structural formula (2)

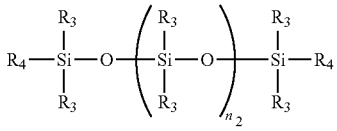

In structural formula (2), $n_2$ represents a positive integer; $R_3$ each independently represents a monovalent unsubstituted or substituted hydrocarbon group which does not contain an unsaturated aliphatic group, but, at least one of $R_3$ represents a methyl group; and $R_4$ each independently represents an unsaturated aliphatic group.

Examples of the monovalent unsubstituted or substituted hydrocarbon group that does not contain an unsaturated aliphatic group, which $R_1$ and $R_3$ in structural formula (1) and structural formula (2) can represent, can include the following groups.

Unsubstituted Hydrocarbon Group

An alkyl group (for example, a methyl group, an ethyl group, a propyl group, a butyl group, a pentyl group and a hexyl group).

Substituted Hydrocarbon Group

An alkyl group (for example, a substituted alkyl group such as a chloromethyl group, a 3-chloropropyl group, a 3,3,3-trifluoropropyl group, a 3-cyanopropyl group and a 3-methoxypropyl group).

The organopolysiloxanes that are respectively represented by structural formula (1) and structural formula (2) have at least one methyl group which is directly bonded to a silicon atom forming a chain structure. However, it is preferable that 50% or more of each of $R_1$ and $R_3$ be a methyl group because synthesis and handling are easy, and it is more preferable that all of $R_1$ and $R_3$ be the methyl group.

In addition, examples of the unsaturated aliphatic group which $R_2$ and $R_4$ in structural formula (1) and structural formula (2) can represent can include the following groups. Specifically, examples of the unsaturated aliphatic groups can include a vinyl group, an allyl group, a 3-butenyl group, a 4-pentenyl group and a 5-hexenyl group.

Among these groups, it is preferable for both of $R_2$ and $R_4$ to be vinyl groups, because synthesis and handling are easy, and a crosslinking reaction is easily performed.

It is preferable that a viscosity of the component (a) be 100 $mm^2/s$ or higher and 50,000 $mm^2/s$ or lower, from the viewpoint of formability. The viscosity (kinematic viscosity) can be measured with the use of a capillary viscometer, a rotational viscometer or the like, based on JIS Z 8803:2011.

It is preferable that the amount of the component (a) to be blended be set at 40% by volume or more based on the addition-curable type liquid silicone rubber composition which is used in forming the elastic layer 2, from the viewpoint of pressure resistance, and be set at 70% by volume or less from the viewpoint of heat transfer properties.

(2-1-3) Component (b)

An organopolysiloxane having active hydrogen bonded to silicon functions as a crosslinking agent which reacts with the unsaturated aliphatic group of the component (a) by an action of a catalyst and forms the cured silicone rubber.

As the component (b), any of organopolysiloxanes can be used as long as the organopolysiloxane has an Si—H bond. In particular, from the viewpoint of reactivity with the unsaturated aliphatic group of the component (a), an organopolysiloxane is preferably used in which the number of hydrogen atoms bonded to a silicon atom is three or more by average in one molecule.

Specific examples of the component (b) include a linear organopolysiloxane which is represented by the following structural formula (3), and a cyclic organopolysiloxane which is represented by the following structural formula (4).

Structural formula (3)

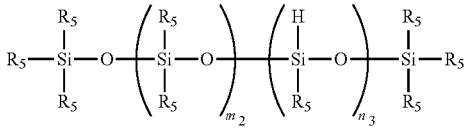

In structural formula (3), $m_2$ represents an integer of 0 or larger, and $n_3$ represents an integer of 3 or larger; and $R_5$ each independently represents a monovalent unsubstituted or substituted hydrocarbon group which does not contain an unsaturated aliphatic group.

Structural formula (4)

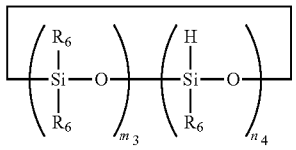

In structural formula (4), $m_3$ represents an integer of 0 or larger, and $n_4$ represents an integer of 3 or larger; and $R_6$ each independently represents a monovalent unsubstituted or substituted hydrocarbon group which does not contain an unsaturated aliphatic group.

Examples of the monovalent unsubstituted or substituted hydrocarbon group that does not contain an unsaturated aliphatic group, which $R_5$ and $R_6$ in structural formula (3) and structural formula (4) can represent, can include similar groups to those for $R_1$ in the above described structural formula (1).

Among the groups, it is preferable that 50% or more of each of $R_5$ and $R_6$ be a methyl group because synthesis and handling are easy and excellent heat resistance is easily obtained, and it is more preferable that all of $R_5$ and $R_6$ be the methyl group.

(2-1-4) Catalyst

Examples of a catalyst which is used for forming the binder can include a hydrosilylation catalyst for accelerating a curing reaction. As the hydrosilylation catalyst, known substances, for example, such as platinum compounds and rhodium compounds can be used. The amount of the catalyst to be blended can be appropriately set, and is not limited in particular.

(2-1-5) Other Additives

Furthermore, in order to impart thermal conductivity, heat resistance, electro-conductivity, reinforcing properties and the like, fillers suitable for respective purposes can be kneaded and dispersed in the silicone rubber composition. The amounts of these additives to be blended can be appropriately set, and are not limited in particular.

(2-1-6) Content of Cured Silicone Rubber

The content of the cured silicone rubber in the elastic layer 2 can be checked, for example, by using a thermogravimetric measurement device (TGA) (for example, trade name: TGA 851, manufactured by Mettler-Toledo).

Specifically, a sample of approximately 20 mg is cut out from the elastic layer 2 by a razor or the like, is accurately weighed, and is placed in an alumina pan for the above described thermogravimetric measurement device. At this time, it is preferable to cut out the cut-out part of the elastic layer 2 so as to include the first surface B1 and the second surface B2 which are surfaces of the elastic layer 2. The alumina pan in which this sample has been placed is set in this apparatus, and is heated from room temperature (for example, 25° C.) to 800° C. at a heating rate of 20° C./min under a nitrogen atmosphere, and is further heated at 800° C. for 1 hour. In the nitrogen atmosphere, as the temperature rises, the cured silicone rubber in the sample is decomposed by cracking without being oxidized and is removed, and accordingly the weight of the sample decreases. Then, the weights before and after the measurement are compared, and thereby the content of the cured silicone rubber which has been contained in the elastic layer 2 can be checked.

(2-2) Filler

The elastic layer 2 contains a specific amount of a filler 2*b* which is retained in a dispersed state in the binder 2*a*, and thereby can improve the heat transfer characteristics when having been used for the fixing member of a heat fixing apparatus. The filler may be dispersed in form of lumps of various sizes as illustrated in FIG. 1B, and it is confirmed that the filler is dispersed in the binder, with a scanning electron microscope (SEM), for example.

The type of the filler can be appropriately selected in consideration of the thermal conductivity, the specific heat capacity, the density, the particle size and the like of the filler itself. Specific fillers can include, for example, inorganic substances, in particular, metals, and metal compounds. Examples of the fillers (thermally conductive fillers) which are used for the purpose of improving heat transfer characteristics include the following.

Silicon nitride; boron nitride; aluminum nitride (AlN); alumina; zinc oxide; titanium oxide; magnesium oxide (MgO); silica; copper; aluminum; silver; iron; nickel; and carbon fiber.

Among the materials, the filler is preferably at least one filler selected from the group consisting of alumina, magnesium oxide, zinc oxide, titanium oxide, aluminum nitride and boron nitride, from the viewpoint of the thermal conductivity.

The content of the filler in the elastic layer is 30% by volume or more to 60% by volume or less based on the total volume of the elastic layer, from the viewpoint of achieving both of the thermal conductivity and the flexibility. In particular, it is preferable to set the content 40% by volume or more to 50% by volume or less. Thereby, the thermal conductivity of the elastic layer 2 can be further improved, and the flexibility of the elastic layer 2 can be easily secured.

(2-3) Low Concentration Region of Filler

In the elastic layer, as illustrated in FIG. 1B, in a region having a thickness of 6 μm of the elastic layer, from a first surface B1 on a side facing the substrate toward a second surface B2 on an opposite side to the first surface B1 of the elastic layer, the content of the filler is small. Hereinafter, this region is also referred to as a low concentration region 2*c*. Specifically, an average value of ratios of an element derived from the filler in the low concentration region, which is calculated from a calculation method that will be described later, is 0.0 atomic % or larger and 6.0 atomic % or smaller. Thereby, the fixing member according to the present aspect is structured so that the filler resists causing a scratch on the substrate even in long-term use. Furthermore, it is preferable in the above described region that the above described average value of ratios of the element derived from the filler is 3.1 atomic % or smaller, from the viewpoint of suppressing the occurrence of the scratch on the substrate resulting from the filler.

(2-4) Method for Confirming Low Concentration Region of Filler

The presence of the low concentration region can be confirmed by measuring a distribution of ratios of the element derived from the filler, with the use of energy dispersion type X-ray analyzer (EDS) which is equipped in a scanning electron microscope (SEM) apparatus. Specifically, the presence of the low concentration region can be confirmed by that an average value of the ratios of the element derived from the filler in the above described substrate-side region of the elastic layer, which is calculated by using the following calculation method, is within the range of 0.0 to 6.0 atomic %.

(Method of calculating average value of ratios of element derived from filler in region of thickness of 6 μm of elastic layer, from first surface on side facing substrate toward second surface on opposite side to first surface)

(i) Collect a plurality of samples for measurement from arbitrary plural portions of the fixing member.

(ii) Polish a cross section in the circumferential direction of the fixing member of the collected measurement sample, in other words, a cross section containing a cross section in the thickness direction and the circumferential direction of the elastic layer, with the use of an ion beam to create a cross section for observation.

(iii) Linearly analyze a ratio of the element derived from the filler at each thickness position which has been prepared at a pitch of 0.1 μm from the first surface on the side facing the substrate of the elastic layer toward the second surface on the opposite side to the first surface, in a region having a thickness of 6 μm from the first surface toward the second surface, in the cross section for observation, on a plurality of portions in the circumferential direction of the fixing member, for example, on 50 portions, with the use of energy dispersion type X-ray analyzer (EDS); and determine the ratio of the element derived from the filler at each thickness position on each of the measurement samples.

(iv) Average the measurement results of the element ratio at each thickness position of a plurality of positions in the circumferential direction of the fixing belt, in the cross section for observation, which has been determined in the above described (iii) to obtain an average value of the ratios of the element derived from the filler at each of the thickness positions (hereinafter also referred to as "first average value").

(v) Perform the above described operations and analyses of (i) to (iv) on the plurality of measurement samples; calculate the first average value of the ratio of the element derived from the filler at each of the thickness positions; determine an arithmetic average value of the first average value; and calculate an average value of ratios of the element derived from the filler at each of the thickness positions (hereinafter also referred to as "second average value").

(vi) Determine the average value of the ratio of the element derived from the filler in the filler low concentration region of the fixing member, from the second average value.

The calculation method will be described in detail below.

Figure 10A:
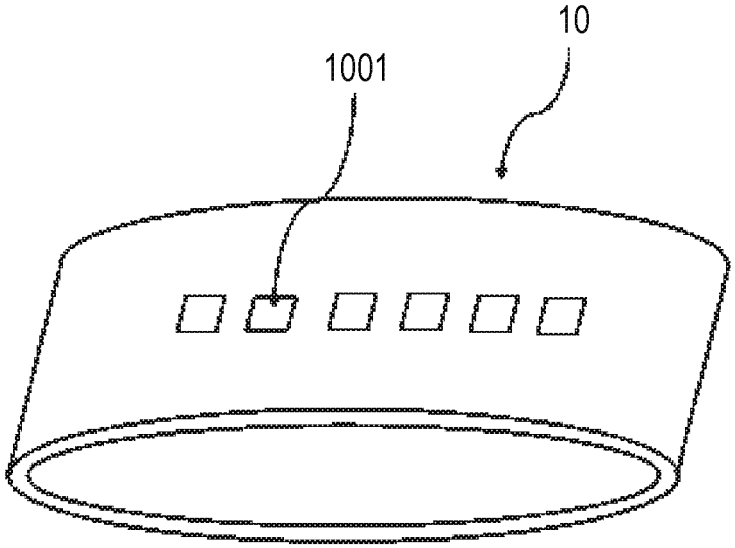
FIG. 10A is an explanatory view of one example of a method for collecting a measurement sample from a fixing belt.
Figure 10B:
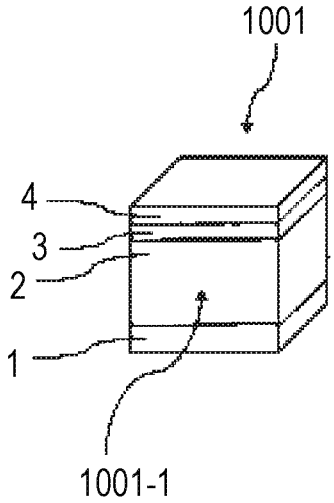
FIG. 10B is an explanatory view of a measurement sample which has been collected from a fixing belt.

(i) First, collect samples for measurement from arbitrary 20 portions in the circumferential direction of the fixing member. When the fixing member is the fixing belt 10 as illustrated in FIG. 10A, collect a measurement sample 1001 in which a length is 5 mm, a width is 5 mm and a thickness is the total thickness of the fixing belt, from arbitrary 20 portions of the fixing belt, as illustrated in FIG. 10B, for example. The positions in the longitudinal direction of the fixing member of 20 portions at which the sample for measurement is collected may be the same or different. FIG. 10A illustrates an example in which the sample for measurement is collected from portions at which the positions in the longitudinal direction are the same and positions in the circumferential direction are different from each other.

(ii) Polish the cross section in the circumferential direction of the fixing belt of the collected measurement sample 1001, in other words, the cross section containing a first cross section 1001-1 in the thickness direction and the circumferential direction of the elastic layer, with the use of an ion beam. For the polishing work of the cross section with an ion beam, a cross section polisher can be used, for example. In the polishing work of the cross section with the ion beam, falling off of the filler from the sample or mixing of a polishing agent can be prevented, and the cross section with few polishing marks can be formed.

Subsequently, form an electro-conductive film, for example, such as a gold-palladium film on the polished cross section to subject the cross section to electro-conducting treatment, and form a cross section for observation. As a method of forming the electro-conductive film, a sputtering method can be used, for example. It is preferable to set a thickness of the electro-conductive film at approximately 1 nm to 90 nm, for example.

Figure 3A:
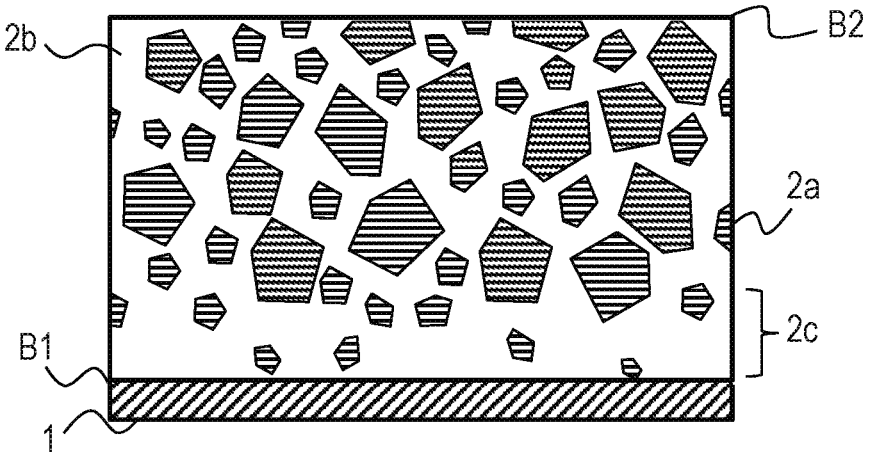
FIG. 3A is a view for describing a method for confirming the low concentration region.
Figure 3B:
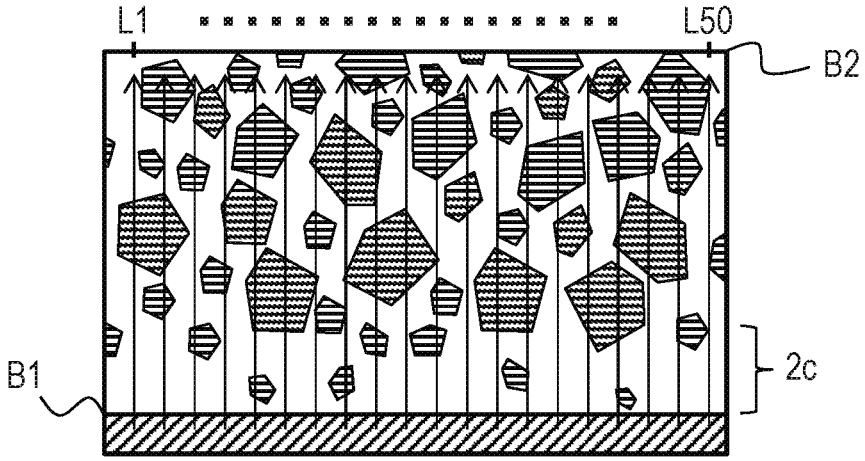
FIG. 3B is a view for describing the method for confirming the low concentration region.

Next, in order to determine the measurement portion by EDS, the cross section for observation is observed with SEM. FIGS. 3A and 3B illustrate a method for confirming the low concentration region of the filler in the cross section for observation. In FIGS. 3A and 3B, the descriptions of the adhesive layer and the releasing layer are omitted.

First, a field of view of SEM is adjusted so that the first surface B1 of the elastic layer is settled within the field of view, as illustrated in FIG. 3A. Here, in at least a part of the cross section for observation, it is preferable for the SEM to adjust the observation magnification appropriately so that the thickness from the first surface B1 of the elastic layer is settled within the field of view within the range of at least 100 μm. This field of view contains a substrate side region (corresponding to portion of reference character 2*c*) of a thickness of at least 6 μm from the first surface B1 toward the second surface B2.

(iii) Measure the element ratio based on this field of view, with the use of EDS. Here, the case will be described as an example, where a fixing belt is an object to be measured, which uses the silicone rubber as the binder of the elastic layer and magnesium oxide as the thermally conductive filler.

As illustrated in FIG. 3B, measure the ratio of the element derived from the filler at each thickness position by EDS, at intervals of 0.1 μm in the direction from the first surface B1 toward the second surface B2, which is indicated by arrows, for each of positions L1 to L50 of arbitrary 50 portions in the circumferential direction of the fixing belt in the cross section for observation. Then, the ratio of the element derived from the filler in the elastic layer at each thickness position, which is a magnesium ratio here, is obtained on each of the portions of L1 to L50.

(iv) Subsequently, average the measurement results in each of the obtained portions at each thickness position to obtain an average value ("first average value") of the ratio of the element derived from the filler at each thickness position. Here, when the element derived from the filler contained in the fixing member to be measured is unknown, the element derived from the filler can be specified by specifying an element of which the atomic concentration becomes high at a position corresponding to the filler in the field of view determined by SEM.

(v) Perform the operations of the above described (i) to (iv) for each of the twenty measurement samples to obtain the first average value of the ratio of the element derived from the filler at each thickness position of each of the measurement samples. Arithmetically average the first average values of the twenty samples at each thickness position to obtain a second average value of the ratio of the element derived from the filler at each thickness position of the fixing belt.

(vi) Subsequently, average the second average values of the ratio of the element derived from the filler at each thickness position to obtain the average value of the ratio of the element derived from the filler in the substrate side region.

(3) Adhesive Layer

The adhesive layer 3 is a layer for bonding the releasing layer 4 to the elastic layer 2. An adhesive to be used for the adhesive layer can be appropriately selected from known adhesives, and is not limited in particular. However, it is preferable to use an addition-curable type silicone rubber which is blended with a self-adhesive component, from the viewpoint of easy handling. This adhesive can contain, for example, a self-adhesive component, an organopolysiloxane having a plurality of unsaturated aliphatic groups represented by a vinyl group in its molecular chain, a hydrogen organopolysiloxane, and a platinum compound as a cross-linking catalyst. The adhesive which has been applied to the surface of the elastic layer can form an adhesive layer by being cured by an addition reaction, which bonds the releasing layer to the elastic layer.

Examples of the above described self-adhesive component can include the following.

- Silane having at least one or preferably two or more functional groups selected from the group consisting of alkenyl groups such as a vinyl group, a (meth)acryloxy group, a hydrosilyl group (SiH group), an epoxy group, an alkoxysilyl group, a carbonyl group and a phenyl group.
- Organosilicon compound such as cyclic or linear siloxane having 2 or more to 30 or less silicon atoms, or preferably 4 or more to 20 or less silicon atoms.
- Non-silicon-based (in other words, containing no silicon atom in the molecule) organic compound which may contain an oxygen atom in the molecule. However, the non-silicon-based organic compound contains 1 or more to 4 or less, or preferably 1 or more to 2 or less aromatic rings such as a phenylene structure having 1 or more to 4 or less valences, or preferably 2 or more to 4 or less valences, in one molecule. The non-silicon-based organic compound also contains at least one, or preferably 2 or more to 4 or less functional groups (for example, alkenyl group and (meth)acryloxy group) which can contribute to a hydrosilylation addition reaction, in one molecule.

The above described self-adhesive components may be used singly or in combinations of two or more.

In addition, a filler component can be added to the adhesive, within a range complying with the scope of the present disclosure, from the viewpoint of adjusting viscosity and securing heat resistance.

Examples of the filler component can include, for example, the following sub stances.

- Silica, alumina, iron oxide, cerium oxide, cerium hydroxide, carbon black and the like.

An amount of each component to be blended which is contained in the adhesive is not limited in particular, and can be appropriately set. Such addition-curable type silicone rubber adhesives are also commercially available, and are easily available.

It is preferable that the thickness of the adhesive layer be 20 μm or less. Due to the thickness set at 20 μm or less, when the fixing member according to the present aspect is used as a heating belt in a heat fixing apparatus, it is possible to easily set the thermal resistance at a small value, and the heat is easy to efficiently transmit from the inner surface side to the recording medium.

(4) Releasing Layer

The releasing layer 4 may contain a fluorocarbon resin (hereinafter referred as "fluorocarbon resin releasing layer"). As the fluorocarbon resin releasing layer, a resinous tube having tubular shaped obtained by molding a resin enumerated as examples below can be employed.

- Tetrafluoroethylene-perfluoro(alkyl vinyl ether) copolymer (PFA), polytetrafluoroethylene (PTFE), tetrafluoroethylene-hexafluoropropylene copolymer (FEP), and the like.

Among the resin materials enumerated above as examples, PFA is preferably used as the releasing layer, from the viewpoint of moldability and toner releasability.

It is preferable that the thickness of the releasing layer be set at 10 μm or more to 50 μm or less. As long as the thickness of the releasing layer is within this range, when the releasing layer is laminated on the elastic layer (specifically, adhesive layer), it is easy to maintain the elasticity of the elastic layer which is arranged on the substrate side, it is easy to maintain an appropriate surface hardness at the time when the releasing layer is used for a fixing member (for example, a heating member), and it is easy to secure the abrasion resistance.

<Method for Manufacturing Fixing Member>

The fixing member according to the present aspect can be manufactured, for example, by a manufacturing method including the following steps.

(i) A step of forming an elastic layer on a substrate, with the use of a composition which contains at least a filler and (a raw material of) a binder (elastic layer forming step).

In addition, the above described manufacturing method can include the following steps.

(ii) A step of providing a substrate (substrate providing step).

(iii) A step of forming an adhesive layer on the elastic layer (adhesive layer forming step).

(iv) A step of forming a releasing layer on the adhesive layer (releasing layer forming step).

The above described step (i) can have the following steps.

(i-1) A step of preparing a composition containing a filler and (a raw material of) a binder (composition preparing step).

(i-2) A step of forming a layer containing the composition on the substrate (composition layer forming step).

(i-3) A step of forming a low concentration region in which a content ratio of the filler is small, in a layer containing the composition (low concentration region forming step).

(i-4) A step of curing the layer containing the composition in which the low concentration region has been formed to form an elastic layer (curing step).

The above described steps (i-2) to (i-4) may be performed sequentially, or be performed in parallel.

Each step will be described in detail below.

(ii) Step of Providing Substrate

First, a substrate 1 is provided which is formed from the above described material. The shape of the substrate can be appropriately set as described above, and can be formed into an endless belt shape, for example. A layer for imparting various functions such as heat insulating properties to the fixing member can be appropriately formed on the inner surface of the substrate, and surface treatment can be applied so as to impart various functions such as adhesiveness to the fixing member also to the outer surface of the substrate.

(i) Elastic Layer Forming Step (i-1) Step of Preparing Composition for Elastic Layer First, a composition for an elastic layer is prepared, which contains a filler and a raw material of a binder.

(i-2) Step of Forming Composition Layer

The composition is applied onto the substrate by a method such as a die molding method, a blade coating method, a nozzle coating method and a ring coating method, and a layer of the composition is formed. The thickness of the composition layer is set at a thickness such that the thickness of the elastic layer becomes 100 μm or more.

(i-3) Step of Forming Low Concentration Region

A low concentration region 2*c* is formed in the composition layer.

As for a method of reducing a content of the filler in a region having a thickness of 6 μm of the composition layer, from the first surface on the side facing the substrate toward the second surface on an opposite side to the side facing the substrate, the following method can be used for example.

Method by arrangement control for the filler by application of an electric field (hereinafter also referred to as "electric field control method");—Method using the difference in specific gravity between the filler 2*b* and the raw material (silicone polymer) of the binder 2*a* (hereinafter also referred to as "specific gravity difference method").

These methods may be used singly or in combination. However, when the low concentration region is formed, it is preferable to use the electric field control method, and it is more preferable to use the electric field control method and the specific gravity difference method in combination, from the viewpoint of the uniformity of the thickness of the low concentration region.

(i-3-1) Electric Field Control Method

In the following, the method for forming the low concentration region in the composition layer will be described in detail, by taking an electric field control method as an example.

A contact method or a non-contact method can be considered as a method for applying an electric field to the composition layer, but it is preferable to use the non-contact method because the composition layer is in an uncured state. As the non-contact method, a method using a corona charger is preferable because the method can easily and inexpensively apply a substantially uniform electric field to the composition layer.

The reason is not clear why the low concentration region in which the content of the filler is small is formed by the application of the electric field to the composition layer. However, the inventors assume the reason in the following way. Specifically, when the electric field is applied to the composition layer, dielectric polarization occurs in the filler 2*b*, and by the electrostatic interaction, attractive forces among fillers are generated in the electric field direction. By an action of the attractive forces, the fillers 2*b* which exist in the vicinity of the first surface in the composition layer move toward the second surface thereby to form a low concentration region in which the content ratio of the filler is small, on the substrate side.

The corona charger which is used for forming the low concentration region of the composition layer will be described in detail below. Here, FIGS. 2A and 2B illustrate explanatory views of the corona charger which can be used when the low concentration region is formed.

Figure 2A:
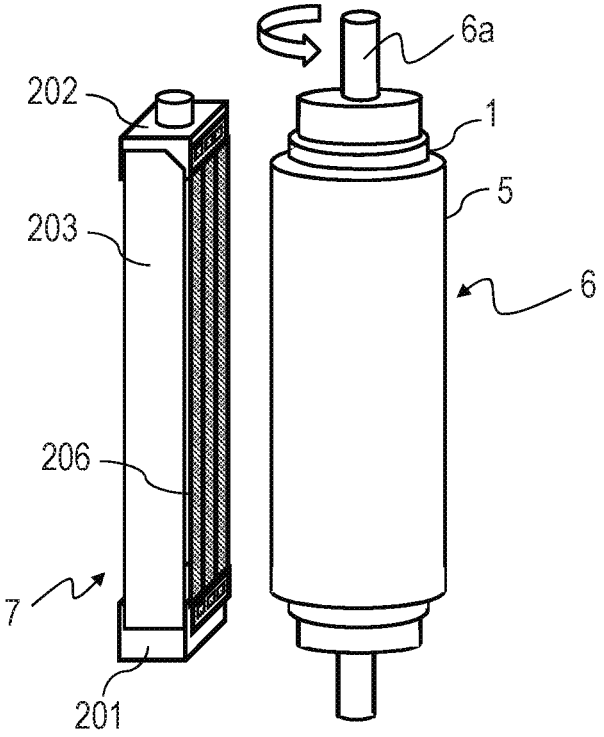
FIG. 2A is an explanatory view of a corona charger, and is a bird's eye view of the corona charger and the fixing member, at the time when a low concentration region is formed.
Figure 2B:
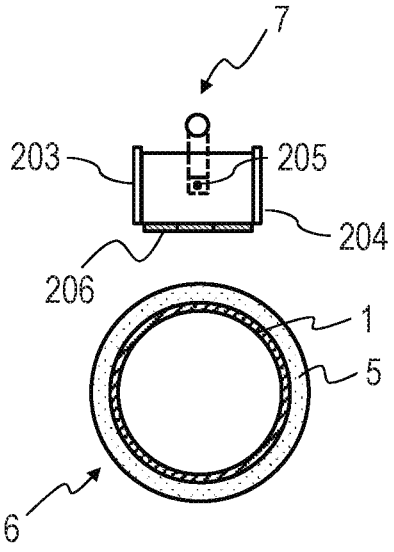
FIG. 2B is a cross-sectional view of the fixing member in the circumferential direction.

The corona charger 7 illustrated in FIGS. 2A and 2B has a structure similar to that of a normal corona charger. Specifically, the corona charger 7 includes a front block 201, a back block 202, shields 203 and 204, and a grid 206. In addition, the corona charger 7 includes a discharge wire 205 as a discharge member, which is stretched between the front block 201 and the back block 202. The corona charger 7 applies a high voltage to the discharge wire 205 by an unillustrated power source for the discharge wire, and applies the high voltage of the ion flow to the grid 206, which is obtained by the discharge to shields 203 and 204.

For the discharge wire 205, materials such as stainless steel, nickel, molybdenum and tungsten can be appropriately used, but it is preferable to use tungsten which is very high in stability among metals. The shape of the discharge wire 205 which is stretched inside the shields 203 and 204 is not limited in particular; and the discharge wire can be used, for example, which has a shape like a saw tooth or shows a cross section with a circular shape (circular cross-sectional shape) when the discharge wire has been vertically cut. It is preferable that the diameter of the discharge wire 205 (in cut surface when cut perpendicular to wire) be 40 μm or more to 100 μm or less. If the diameter of the discharge wire 205 is 40 μm or more, the discharge wire can easily prevent itself from being cut or broken by the collision of ions due to the discharge. If the diameter of the discharge wire 205 is 100 μm or less, the corona charger can apply an appropriate application voltage to the discharge wire 205 at the time of corona discharge, and can easily prevent the production of ozone.

As illustrated in FIG. 2B, a tabular grid 206 can be arranged between the discharge wire 205 and the composition layer 5 which is arranged on the substrate 1. Here, it is preferable to set a distance between the surface of the composition layer 5 and the grid 206 in the range of 1 mm to 10 mm, from the viewpoint of uniformalizing the charging potential on the surface of the composition layer 5.

With the use of such corona charger, the surface of the composition layer 5 which is an object to be charged is charged and controlled to a desired charging potential. At this time, the substrate or the core for holding the substrate is grounded (unillustrated), and accordingly, a desired electric field can be generated in the composition layer by a control of the surface potential of the surface of the composition layer.

As for a voltage applied to the discharge wire 205, a DC voltage or an AC voltage can be appropriately selected and used. As for the voltage in the case of an alternating voltage, it is preferable that the frequency be 1 Hz or higher and 1000 Hz or lower. The voltage can be applied by an arbitrary waveform generator which outputs a rectangular wave, a sine wave or the like. It is preferable for the voltage to be applied to the grid 206 to be in the range of 0.3 kV or higher and 3 kV or lower in terms of an absolute value, and more preferable to be in the range of 0.6 kV or higher and 2 kV or lower in terms of the absolute value, from the viewpoint of generating the electrostatic interaction which is effective among the fillers. If the voltage to be applied to the grid is 3 kV (preferably, 2 kV) or lower, the voltage can easily generate an appropriate action of the attractive forces even at a portion in which the fillers 2*b* locally agglomerate, and can impart an excellent surface property to the elastic layer.

In the case where the low concentration region in which the content ratio of the filler is small is formed by using the electric field, it is important to generate the electric field in the thickness direction of the composition layer. If a sign of the voltage applied to the fixing member 6 before the low concentration region is formed is set at an equal sign to that of the voltage to be applied to the discharge wire 205, even if the sign is minus or plus, the obtained effects are the same though the direction of the electric field is opposite.

Here, there is a case where the low concentration region 2*c* resists being formed, depending on the type of the filler 2*b*. This phenomenon is assumed to be associated with dielectric constants of the binder component and the filler. In this case, it is preferable to increase the voltage to be applied to the grid 206. On the other hand, when the difference in the dielectric constant is large between the binder and filler, the low concentration region 2*c* can be formed by a relatively small applied voltage.

It is preferable that a range of potential control in the longitudinal direction of the surface of the composition layer, in other words, in the vertical direction of the paper face of FIG. 2A be a contact area of a recording medium on the fixing member, for example, the sheet passing area of the fixing member, or wider. The arrangement configuration of the corona charger 7 and the fixing member 6 before the low concentration region is formed can be a configuration which is illustrated, for example, in FIG. 2A, and the corona charger 7 and the fixing member 6 are arranged in an opposed way so that the longitudinal direction of the corona charger 7 becomes substantially parallel to the longitudinal direction of the fixing member 6. Then, the voltage is applied to the grid 206 while the fixing member 6 is rotated around the central axis 6*a* which is the rotation axis, and thereby the whole composition layer 5 can be easily charged.

It is preferable that the rotational frequency of the fixing member when the electric field control method is performed be 10 rpm or more to 500 rpm or less. In addition, it is preferable to set the time of charging treatment by the corona charger at 5 seconds or longer and 120 seconds or shorter, from the viewpoint of stably forming the low concentration region in the composition layer.

(i-3-2) Specific Gravity Difference Method

Next, a method for forming the low concentration region in the composition layer by use of a difference in specific gravity between the filler and the binder will be described.

In this method, the low concentration region 2*c* in which the content ratio of the filler is small can be formed in a specific region of a substrate interface (first surface B1) by using a (thermally conductive) filler 2*b* of which the specific gravity is large. Here, the method will be described while taking the case as an example, where a silicone polymer is used for the binder, alumina is selected and used as the filler, and a fixing belt is formed.

The specific gravity of the silicone polymer is 1, and the specific gravity of alumina is 3.9.

First, the alumina filler is uniformly dispersed in the silicone polymer, and a silicone rubber composition is prepared (composition preparing step). Then, a layer of the composition is supported on the substrate (composition layer forming step), a belt having the substrate and the composition layer is rotated around the central axis which is the rotation axis, and thereby a centrifugal force is generated. By doing so, the alumina filler moves to a side opposite to the substrate, and a low concentration region of the filler can be formed on the substrate side of the silicone rubber composition layer.

(i-4) Curing Step

Next, the composition layer having the low concentration region is cured, for example, by heating, which has been formed by the above described method or the like. The conditions at the time of curing (heating temperature, heating time and the like) can be appropriately adjusted according to the amounts of an unsaturated aliphatic group, a silicon atom-bonded hydrogen group, a hydrosilylation catalyst and the like, which are contained in the silicone rubber composition that has been used for forming the composition layer. For example, it is possible to cure the silicone rubber composition layer by heating the uncured silicone rubber composition layer to 100° C. or higher and 180° C. or lower, as primary curing. Furthermore, it is possible to promote the hydrosilylation reaction, in other words, curing, by heating the composition layer at approximately 200° C. after the primary curing.

According to the above description, the elastic layer 2 having the low concentration region 2*c* can be formed on the substrate 1.

(iii) Step of Forming Adhesive Layer and Step of Forming Releasing Layer

Figure 4:
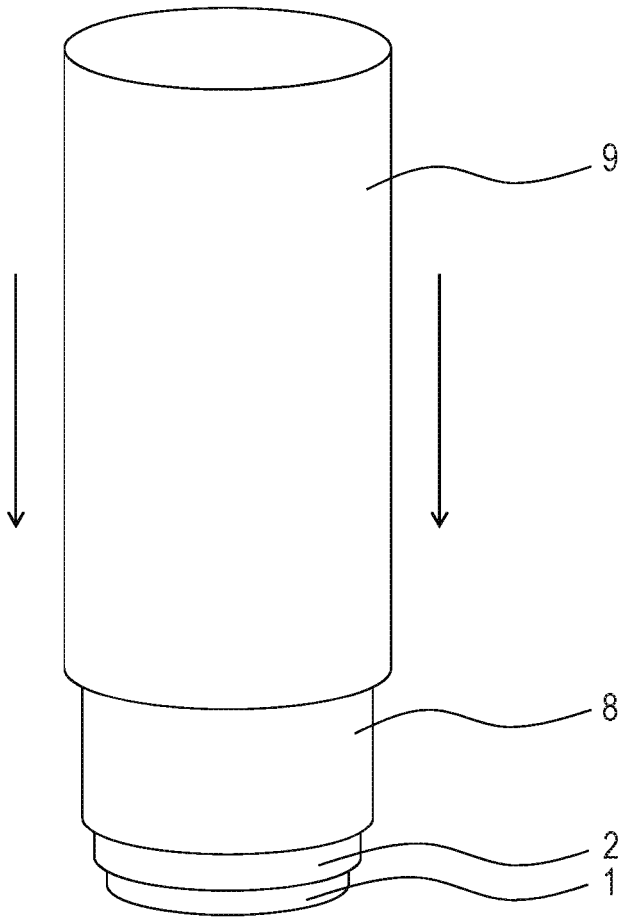
FIG. 4 is a view for describing one example of an adhesive layer forming step and a releasing layer forming step.

Next, as is illustrated in FIG. 4, an adhesive 8 such as an addition-curable type silicone rubber adhesive is applied onto the second surface B2 of the elastic layer 2 formed on the substrate 1, and then is covered with a resin tube 9.

A method for covering the resin tube 9 is not limited in particular, but usable methods include a method of covering the adhesive while regarding the adhesive as a lubricant, and a method of expanding the resin tube from the outside and covering the adhesive 8.

If the inner surface of the resin tube 9 is previously subjected to treatments such as sodium treatment, excimer laser treatment and ammonia treatment, the treatments can further enhance adhesiveness of the inner surface with the adhesive layer.

Here, it is also possible to extract the excess adhesive 8 which has remained between the elastic layer 2 and the resin tube 9 with the use of unillustrated means and thereby to remove the adhesive. It is preferable to control the thickness of the adhesive layer after the adhesive layer has been removed to 20 μm or less, from the viewpoint of the heat transfer properties.

Next, the member having the adhesive 8 and the resin tube 9 on the elastic layer is heated by a heating unit such as an electric furnace for a predetermined period of time, thereby the adhesive 8 is cured and adhered to the resin tube 9, and the adhesive layer 3 and the releasing layer 4 can be formed on the elastic layer 2. The conditions of the heating time, the heating temperature and the like can be appropriately set according to the adhesive which has been used and the like. Both ends of the obtained member are cut into a desired length, and the fixing belt according to the present aspect can be obtained.

<Heat Fixing Apparatus>

In a heat fixing apparatus according to one aspect of the present disclosure, a pair of rotating bodies which work as fixing members such as a pair of heated roller and roller, a belt and a roller, and a belt and a belt are arranged so as to come in pressure contact with each other. Such a fixing member has the fixing member according to the present aspect.

(1) Heating Belt—Pressing Belt Type of Heat Fixing Apparatus

Figure 5:
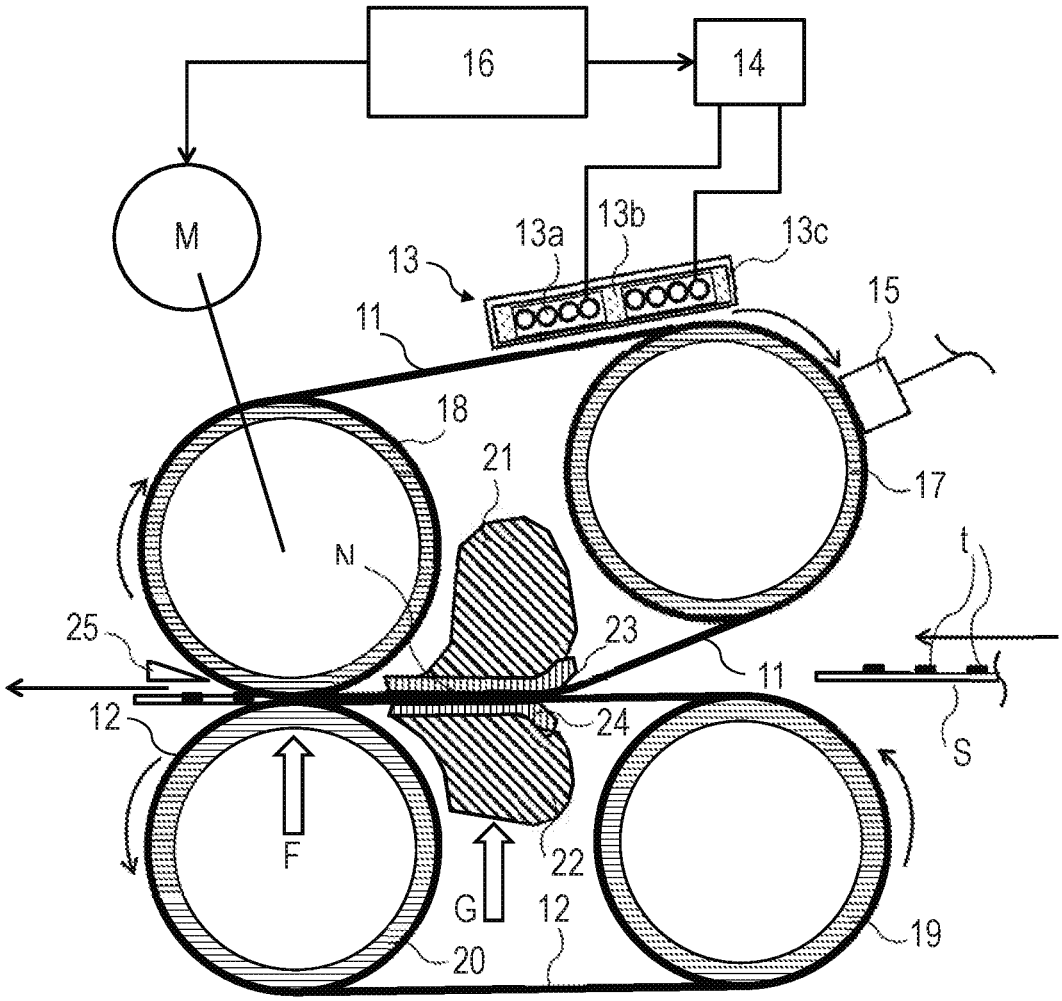
FIG. 5 is a schematic cross-sectional view of one example of a heating belt-pressing belt type of heat fixing apparatus.
Figure 6A:
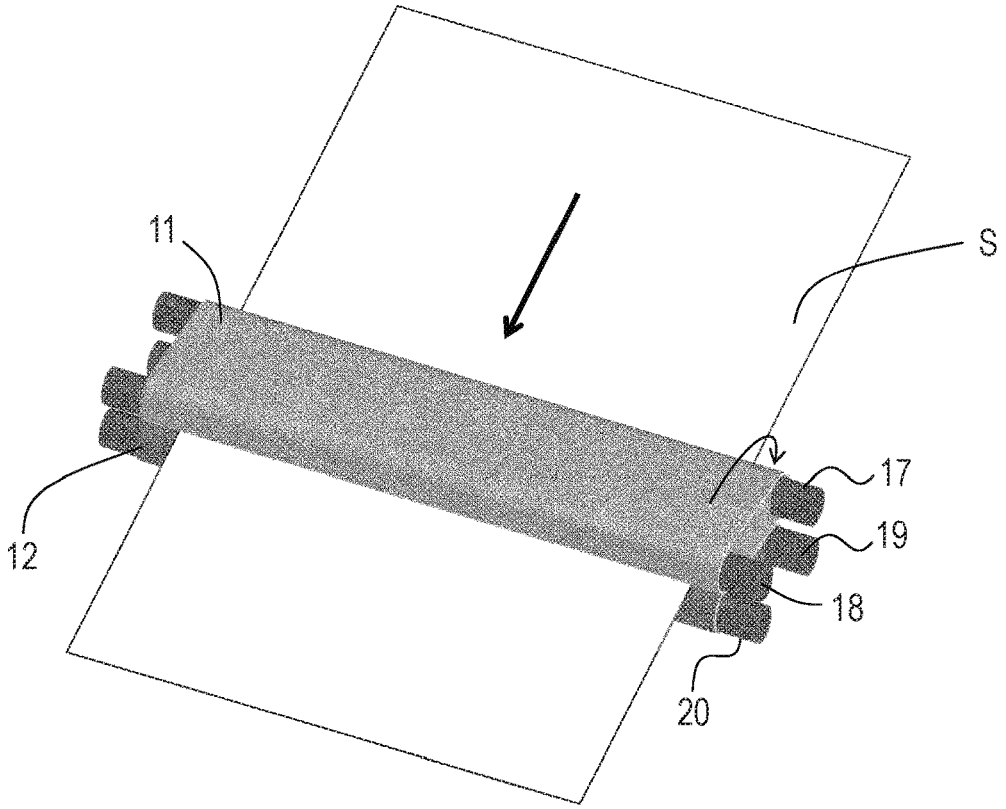
FIG. 6A is a schematic perspective view illustrating a conveyance example in which as a recording media, a sheet of paper is used.
Figure 6B:
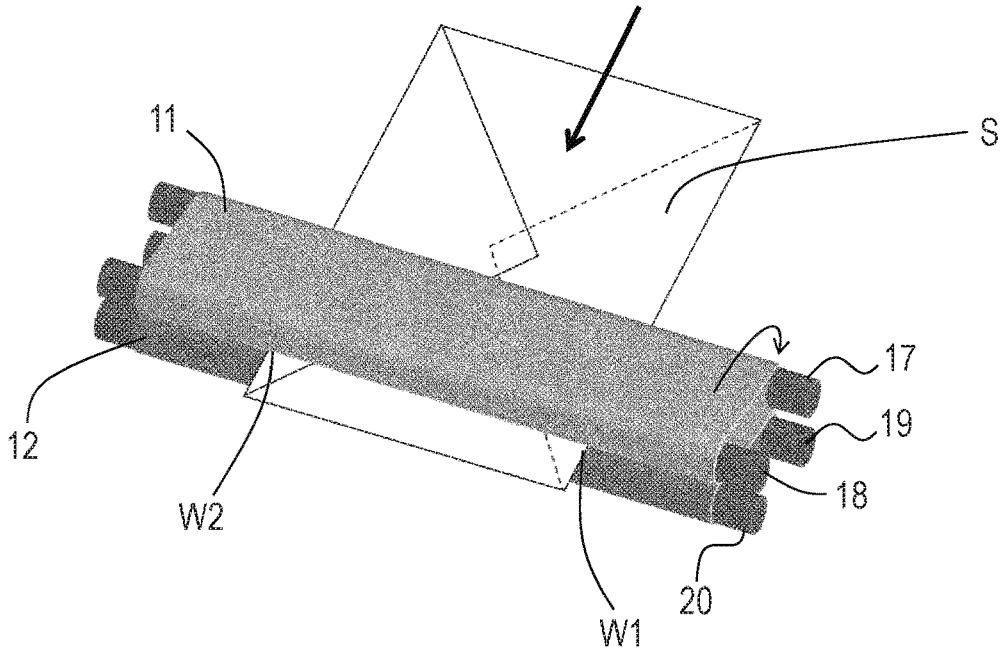
FIG. 6B is a schematic perspective view illustrating a conveyance example in which as a recording media, an envelope is used.

An electromagnetic induction heating type of a heat fixing apparatus is illustrated as one example of a heat fixing apparatus according to the present aspect, with reference to FIGS. 5, 6A and 6B. This heat fixing apparatus includes a heating belt 11 as the heating member, and a pressing belt 12 as a pressing member which is arranged opposite to the heating member and is brought into pressure contact with the heating member. In addition, the heating belt 11 has the fixing member according to the present aspect.

Here, a straight side or the longitudinal direction in the heat fixing apparatus illustrated in FIG. 5 or in each member constituting the heat fixing apparatus means an axial direction of the substrate of the roller which stretches the heating belt 11, in other words, a direction perpendicular to the paper face illustrated in FIG. 5. In addition, a front face in the heat fixing apparatus illustrated in FIG. 5, FIG. 6A and FIG. 6B means a face on an introduction side of a recording medium S. Left and right in the heat fixing apparatus illustrated in these figures mean the left or the right when the heat fixing apparatus is viewed from the above described front face.

Furthermore, a width of the belt means a dimension in the above described longitudinal direction. In addition, a width of the recording medium means a dimension of the recording medium in the above described longitudinal direction. In addition, an upstream or a downstream side in the heat fixing apparatus means an upstream or a downstream side with respect to a conveyance direction of the recording medium.

In the heat fixing apparatus illustrated in FIG. 5, a fixing nip N is formed by the heating belt 11 and the pressing belt 12 being brought into pressure contact with each other, which are the fixing members. Then, in a state in which the heating belt 11 rises to a predetermined fixing temperature and the temperature is adjusted, the fixing nip N sandwiches and conveys the recording medium S of an object to be heated, which has an unfixed toner image t thereon that has been formed by the toner. The recording medium S is introduced so that the surface carrying the unfixed toner image t thereon faces the heating belt 11 side. Then, the unfixed toner image t of the recording medium S is sandwiched and conveyed while being brought in close contact with the outer circumferential surface of the heating belt 11, thereby heat is given from the heating belt 11, and the unfixed toner image t receives a pressing force. As a result, the toner image is melted, and the color is mixed. After that, the toner image is cooled, and thereby the toner image is fixed on the recording medium S. After that, the recording medium S is separated from the heating belt by a separating member 25, and is conveyed.

In the heat fixing apparatus illustrated in FIG. 5, an electromagnetic induction heating type of a heating source (induction heating member and exciting coil) of which the energy efficiency is high is adopted as the heating unit of the heating belt 11. The induction heating member 13 includes an induction coil 13*a*, an excitation core 13*b*, and a coil holder 13*c* for holding the coil and the core. The induction coil 13*a* uses a litz wire which is flatly wound into an oval shape, and is arranged in an excitation core 13*b* having a horizontal E-shape which protrudes in the center of the induction coil and on both sides. The excitation core 13*b* uses a material of which the magnetic permeability is high and of which the remanent flux density is low, such as ferrite, permalloy and the like, accordingly can reduce the loss in the induction coil 13*a* and in the excitation core 13*b*, and can efficiently heat the heating belt 11.

When a high frequency current is passed from the excitation circuit 14 to the induction coil 13*a* of the induction heating member 13, the substrate of the heating belt 11 generates heat by induction, and the heating belt 11 is heated. The surface temperature of the heating belt 11 is detected by a temperature detection element 15 such as a thermistor. A signal relating to the temperature of the heating belt 11, which is detected by the temperature detection element 15, is input to a control circuit unit 16. The control circuit unit 16 controls an electric power supplied from the excitation circuit 14 to the induction coil 13*a* so that temperature information input from the temperature detection element 15 is maintained to be a predetermined fixing temperature, and adjusts a temperature of the heating belt 11 to the predetermined temperature.

The heating belt 11 is stretched by a roller 17 and a driving roller 18 which are belt suspension members. The roller 17 and the driving roller 18 are each rotatably supported by bearing between left and right side plates (unillustrated) of the heat fixing apparatus, and are supported. The roller 17 can be, for example, a hollow roller made of iron, of which the outer diameter is 20 mm, of which the inner diameter is 18 mm and of which the thickness is 1 mm; and functions as a tension roller which applies tension to the heating belt 11.

The driving roller 18 can be, for example, an elastic roller that has a silicone rubber layer provided on a cored bar made of an iron alloy as an elastic layer, of which the outer diameter is 20 mm and of which the inner diameter is 18 mm. To the driving roller 18, a driving force is input from a driving source (motor) M via an unillustrated driving gear train, and the driving roller 18 is rotationally driven at a predetermined speed in the clockwise direction of the arrow. The driving roller 18 has the silicone rubber layer as the elastic layer, and thereby can have the following effects. Specifically, the driving roller 18 can adequately transmit the driving force which has been input thereinto to the heating belt 11, and also can easily form the fixing nip N for securing the separableness of the recording medium S from the heating belt 11. Furthermore, since the driving roller 18 has an elastic layer, thereby the heat conduction to the inside also becomes less, and accordingly a warm-up time can be shortened.

When the driving roller 18 is rotationally driven, the heating belt 11 is rotated together with the roller 17 by a friction between an outer surface of the driving roller 18 (surface of silicone rubber layer) and an inner surface of the heating belt 11 (for example, inner surface of substrate). The arrangement and size of the roller 17 and the driving roller 18 are selected according to the size of the heating belt 11. For example, the dimensions of the above described roller 17 and the driving roller 18 are selected so as to be capable of stretching the heating belt 11 of which the inner diameter is 55 mm at the time when the heating belt 11 is not mounted.

The pressing belt 12 is stretched by a tension roller 19 and a pressing side roller 20 which function as belt suspension members. The inner diameter of the pressing belt 12 at the time when being not mounted can be, for example, set at 55 mm. The tension roller 19 and the pressing side roller 20 are each rotatably supported by bearing between left and right side plates (unillustrated) of the heat fixing apparatus, and are supported.

The tension roller 19 can be structured so as to have a silicone sponge layer provided, for example, on a cored bar made of an iron alloy, of which the outer diameter is 20 mm and of which the inner diameter is 16 mm, in order to lower the thermal conductivity and reduce the heat conduction from the pressing belt 12.

The pressing side roller 20 can be, for example, a rigid roller that is made of an iron alloy and has low slidability, and of which the outer diameter is 20 mm, of which the inner diameter is 16 mm and of which the thickness is 2 mm.

Here, a pressing mechanism (unillustrated) presses the left and right end sides of the rotation shaft of the pressing side roller 20 toward the driving roller 18 with a predetermined pressing force in the direction of an arrow F, so as to form the nip portion N between the heating belt 11 and the pressing belt 12.

In addition, a pressing pad is adopted so as to obtain a wide nip N without upsizing the heat fixing apparatus. Specifically, the pressing pads are a fixing pad 21 which functions as a first pressing pad for pressing the heating belt 11 toward the pressing belt 12, and a pressing pad 22 which functions as a second pressing pad for pressing the pressing belt 12 toward the heating belt 11. The fixing pad 21 and the pressing pad 22 are arranged so as to be supported between the left and right side plates (unillustrated) of the heat fixing apparatus. The pressing pad 22 is pressed toward the fixing pad 21 with a predetermined pressing force in the direction of an arrow G, by a pressing mechanism (unillustrated). The fixing pad 21 that is the first pressing pad has a pad substrate and a sliding sheet (low friction sheet) 23 which comes in contact with the belt. The pressing pad 22 that is the second pressing pad also has a pad substrate and a sliding sheet 24 which comes in contact with the belt. This is because the scraping of the portion of the pad increases, which rubs against the inner circumferential surface of the belt. The sliding sheets 23 and 24 being interposed between the belt and the pad substrate thereby prevents the scraping of the pad, and can also reduce the sliding resistance; and accordingly can easily secure satisfactory running performance and durability of the belt.

A non-contact type static elimination brush (unillustrated) is provided for the heating belt 11, and a contact-type static elimination brush (unillustrated) is provided for the pressing belt 12.

The control circuit unit 16 drives the motor M at least when image formation is carried out. Thereby, the driving roller 18 is rotationally driven, and the heating belt 11 is rotationally driven in the same direction. The pressing belt 12 rotates by being driven by the heating belt 11. Here, the heat fixing apparatus is configured so that (driving roller 18 and pressing side roller 20 sandwiches the heating belt 11 and the pressing belt 12 at a portion on the most downstream side of the fixing nip. The configuration can prevent the slip of the belt. The portion on the most downstream side of the fixing nip is a portion at which a pressure distribution, i.e.in recording medium conveyance direction, in the fixing nip becomes maximum.

Here, FIG. 6A is a schematic perspective view illustrating an example of conveyance in which as a recording medium L, a sheet paper is used in the heat fixing apparatus illustrated in FIG. 5. FIG. 6B is a schematic perspective view illustrating an example of conveyance in which as a recording medium S, an envelope is used. In these figures, some of component members illustrated in FIG. 5 are omitted. Since the thickness of the envelope is thicker than the sheet paper, when the recording medium S is conveyed and introduced into the heat fixing apparatus from a front face direction, a large pressure results in being generated in the heating belt 11 at portions corresponding to ends W1 and W2 of a width direction of the recording medium S.

Figures 1, 8A:
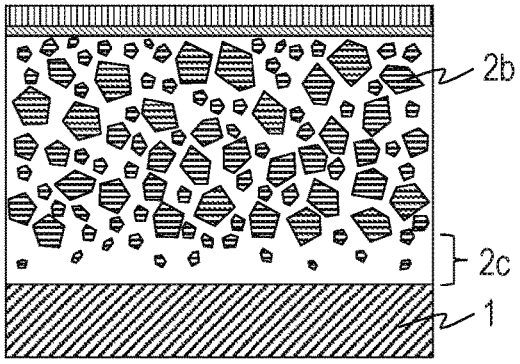
FIG. 8A-1 is a view for describing a state of an elastic layer of the fixing member at the time when a recording medium is conveyed, and is a view corresponding to the fixing member of the present disclosure.
Figures 1, 8B:
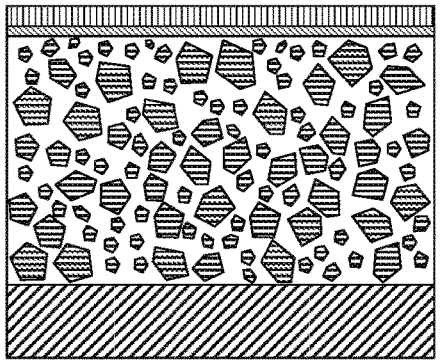
Figures 2, 8A:
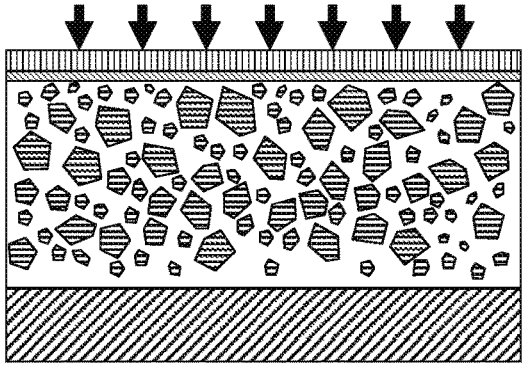
Figures 2, 8B:
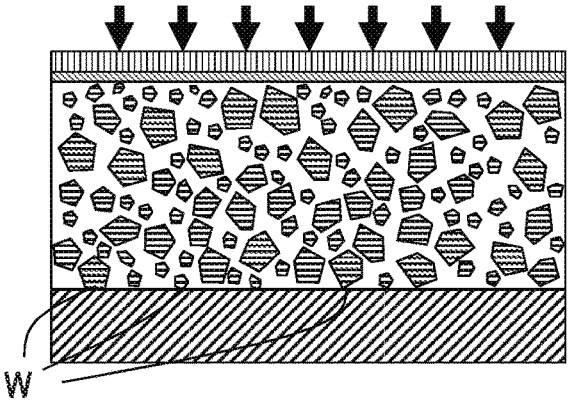

FIG. 8A-1 and FIG. 8A-2 illustrate partial cross-sectional views in the circumferential direction of heating belts in a non-pressure state and in a pressed state due to the conveyance of the recording medium, respectively, at the time when the fixing member according to the present aspect is used as the heating belt, in the heat fixing apparatus according to the present aspect. FIG. 8B-1 and FIG. 8B-2 are partial cross-sectional views in the circumferential direction of heating belts, in a non-pressure state and in a pressed state due to the conveyance of the recording medium, respectively, in the heating belt mounted in a conventional heat fixing apparatus.

Here, for example, as illustrated in FIG. 6B, when the envelope or the like is used as the recording medium S, elastic layer portions at the ends W1 and W2 result in being deformed larger than usual. Because of this, as illustrated in FIG. 8B-1, in the conventional heating belt in which a large amount of the fillers 2*b* contained in the elastic layer exists also in a specific region on the substrate side, the fillers 2*b* result in being brought into pressure contact with the substrate 1 when the elastic layer has been pressed, as illustrated in FIG. 8B-2, and there has been a case where a scratch is formed on the pressure contact part W of the substrate. However, as illustrated in FIG. 8A-1, in the fixing member of the present disclosure, the low concentration region 2*c* in which a content ratio of the filler 2*b* is small is formed on the substrate side of the elastic layer. Because of this, even though thick paper such as the envelope has been conveyed and introduced into the heat fixing apparatus, as illustrated in FIG. 8A-2, the fixing member can suppress that the filler 2*b* is brought in pressure contact with substrate 1 even when the fixing member has been pressed. Because of this, the fixing member can minimize the occurrence of the scratch on the substrate, which is caused by the filler contained in the elastic layer.

(2) Heating Belt-Pressing Roller Type Heat Fixing Apparatus

Figure 7:
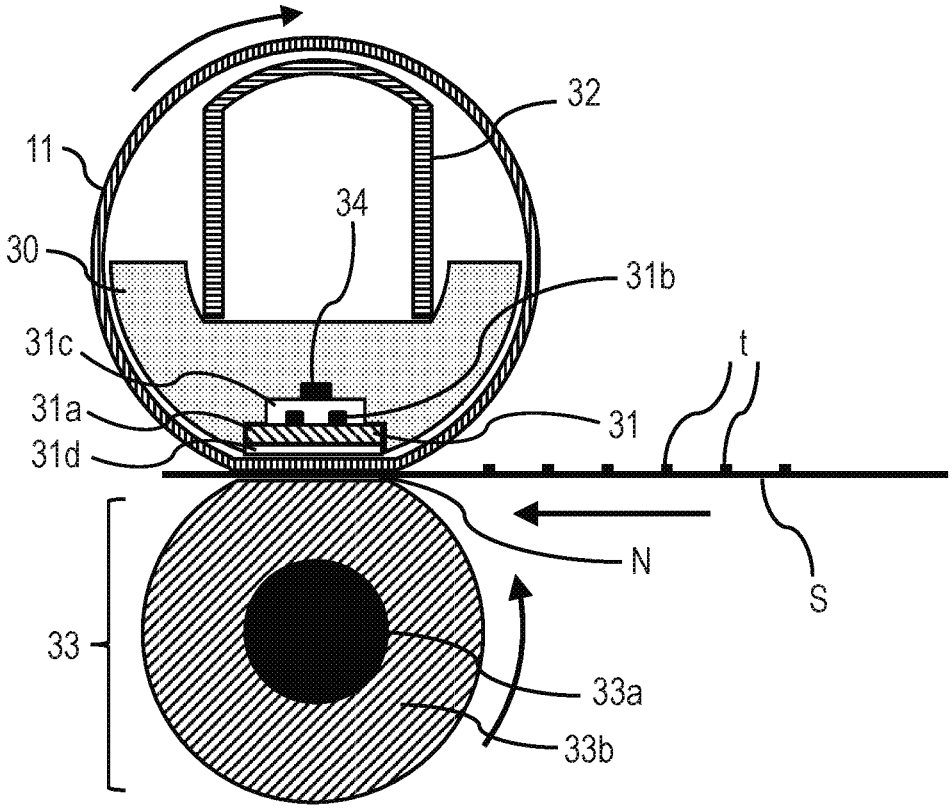
FIG. 7 is a schematic cross-sectional view of one example of a heating belt-pressing roller type of heat fixing apparatus.

FIG. 7 is a sectional view illustrating an example of a heating belt-pressing roller type of a heat fixing apparatus using a heater (specifically, ceramic heater) as a heating unit (heating body) for heating (substrate of) a fixing member. In FIG. 7, reference numeral 11 denotes a heating belt with a cylindrical or endless belt shape, and the fixing member of the present aspect can be used. There is a heat-resistant and heat-insulating belt guide 30 for holding the heating belt 11, and at a position (approximately at the center of the lower face of the belt guide 30) in contact with the heating belt 11, a ceramic heater 31 for heating the heating belt 11 is fitted into a groove portion which is formed along the longitudinal direction of the guide, and is fixedly supported there. Thus, the ceramic heater 31 is arranged in contact with the inner circumferential surface of (substrate of) the heating belt 11. The heating belt 11 is loosely fitted onto the belt guide 30. In addition, a rigid stay 32 for pressing is inserted inside the belt guide 30.

On the other hand, a pressing roller 33 is arranged which opposes to the heating belt 11. In the present example, the pressing roller is an elastic pressing roller that is specifically a pressing roller in which an elastic layer 33*b* of silicone rubber is provided around a cored bar 33*a* to reduce the hardness, and both ends of the cored bar 33*a* are rotatably supported by bearings between unillustrated chassis side plates on the near side and rear side of the apparatus. The elastic pressing roller is covered with a PFA (tetrafluoroethylene/perfluoroalkylether copolymer) tube, in order to improve the surface properties.

The pressing springs (unillustrated) are provided in a compressed state between both ends of the rigid stay 32 for pressing and spring receiving members (unillustrated) on the apparatus chassis side, and exert a depressing force on the rigid stay 32 for pressing. Thereby, a lower surface of the ceramic heater 31 which is arranged on the lower surface of the belt guide 30 made of a heat resistant resin and an upper surface of the pressing roller 33 are brought into pressure contact with each other so as to sandwich the heating belt 11, and form a fixing nip N.

The pressing roller 33 is rotationally driven counterclockwise by unillustrated driving means, as indicated by an arrow. A rotational force acts on the heating belt 11, which is caused by a frictional force between the pressing roller 33 and the outer surface of the heating belt 11 due to the rotational driving of the pressing roller 33, and the inner surface of the heating belt 11 is brought into close contact with the lower surface of the ceramic heater 31 in the fixing nip N, and while sliding, rotates around the belt guide 30 at a peripheral velocity almost corresponding to the rotational peripheral velocity of the pressing roller 33 in the clockwise direction as indicated by the arrow (pressing roller driving system).

Based on the print start signal, the rotation of the pressing roller 33 is started, and the heat-up of the ceramic heater 31 is started. At the moment when the peripheral velocity of the rotation of the heating belt 11 due to the rotation of the pressing roller 33 becomes a steady state, and a temperature of a temperature detection element 34 provided on the upper surface of the ceramic heater has risen to a predetermined temperature, for example, 180° C., a recording medium S which carries an unfixed toner image t thereon as a material to be heated is introduced in between the heating belt 11 of the fixing nip N and the pressing roller 33 so that the toner image carrying surface side faces the heating belt 11 side. Then, in the fixing nip N, the recording medium S comes in close contact with the lower surface of the ceramic heater 31 via the heating belt 11, and moves and passes through the fixing nip N together with the heating belt 11. In the moving and passing step, the heat of the heating belt 11 is imparted to the recording medium S, and the toner image t is heated and fixed on the surface of the recording medium S. The recording medium S which has passed through the fixing nip N is separated from the outer surface of the heating belt 11, and is conveyed.

The ceramic heater 31 of a heating body is a horizontally long linear heating body with low heat capacity, of which the straight side is a direction perpendicular to a movement direction of the heating belt 11 and the recording medium S. The ceramic heater 31 has preferably a basic structure that includes a heater substrate 31*a*, a heat generating layer 31*b* which is provided on the surface of the heater substrate 31*a* along the straight side thereof, a protective layer 31*c* provided further thereon, and a sliding member 31*d*. The heater substrate 31*a* can be formed of aluminum nitride or the like, and the protective layer 31*c* can be formed of glass, a fluorocarbon resin or the like. In addition, the heat generating layer 31*b* can be formed by forming the coating on an electrical resistance material, for example, such as Ag/Pd (silver/palladium), by screen printing or the like so that the thickness becomes approximately 10 μm and the width (in the longitudinal direction) becomes 1 to 5 mm.

The ceramic heater which is used for the heat fixing apparatus is not limited to such a ceramic heater.

Then, by an electric current being supplied between both ends of the heat generating layer 31*b* of the ceramic heater 31, the heat generating layer 31*b* generates heat, and the temperature of the ceramic heater 31 rapidly rises. The ceramic heater 31 is inserted into a groove so that the protective layer 31*c* side directs upward, which has been formed approximately in the center of the lower surface of the belt guide 30 along the straight side of the guide, and is fixedly supported there. In the fixing nip N at which the ceramic heater 31 comes in contact with the heating belt 11, the surface of the sliding member 31*d* of the ceramic heater 31 and the inner surface of the heating belt 11 slide in contact with each other.

The heat fixing apparatus of the present embodiment can be applied also to any image forming apparatus which includes a step of fixing the recording material on the object to be recorded. Among them, the image forming apparatus is preferably an electrophotographic type image forming apparatus in which a toner is used as the recording material, and an electrostatic latent image formed on a photosensitive member (photoreceptor) is developed by the toner and is transferred onto the object to be recorded.

According to one aspect of the present disclosure, there is provided a fixing member that can perform stable heat fixing even in long-term use. In addition, according to another aspect of the present disclosure, there is provided a heat fixing apparatus that can stably form a high quality electrophotographic image.

EXAMPLE

The present disclosure will be described in more detail below with reference to examples. However, the present disclosure shall not be limited to these examples.

Example 1

(1) Preparation of Fixing Belt (1-1) Substrate Providing Step

A nickel electroformed endless sleeve was provided as a substrate, of which the inner diameter was 55 mm, of which the width (length in axial direction at the time when the substrate was stretched as belt) was 420 mm, and of which the thickness was 65 μm. In a series of manufacturing steps, the endless sleeve was handled in a state of having a core inserted in the inside.

Next, a primer (trade name: DY39-051A/B, manufactured by Dow Corning Toray Co., Ltd.) was approximately uniformly applied onto the outer circumferential surface of the substrate so that a dry weight became 30 mg, the solvent was dried, and baking treatment was performed in an electric furnace which was set at 160° C., for 30 minutes.

(1-2) Elastic Layer Forming Step (1-2-1) Composition Preparation Step

Subsequently, a silicone rubber composition which was used for forming an elastic layer was prepared according to the following method. First, a crosslinking agent, a catalyst and the like shown in the following Table 1 were added and sufficiently mixed to have obtained 100 parts by mass in total of a raw material (silicone polymer) for the binder.

TABLE 1

| Raw materials for binder | Parts by mass |
|---|---|
| Component (a): a methyl group-containing silicone polymer (weight average molecular weight 28000) having unsaturated aliphatic groups at both ends (silicone polymer having a vinyl group introduced into an end portion, which is represented by the above described structural formula (2) wherein each $R_3$ represents a methyl group and each $R_4$ represents a vinyl group) | 98.6 |
| Component (b): a methyl group-containing silicone polymer (weight average molecular weight 2000) which is represented by the above described structural formula (3) wherein each $R_5$ represents a methyl group and in which the amount of hydrosilyl groups introduced is 19.5% by silicon atom ratio | 1.3 |
| Component (c): Platinum catalyst (platinum-carbonylcyclovinylmethylsiloxane complex) | 0.1 |

To the raw material for the binder, a plurality of fillers shown in the following Table 2 were added and thoroughly kneaded, and a silicone rubber composition was obtained. Here, the ratio of the content of magnesium oxide (A) in the silicone rubber composition was 40% by volume, and the ratio of the content of magnesium oxide (B) was 3% by volume. Accordingly, the ratio of the content in total of the fillers in the silicone rubber composition was 43% by volume.

TABLE 2

| thermally conductive filler | Parts by mass |
|---|---|
| Magnesium oxide (A) (trade name: SL-WR, manufactured by Konoshima Chemical Co., Ltd., and average particle size 10 μm) | 253.0 |
| Magnesium oxide (B) (trade name: PSFWR, manufactured by Konoshima Chemical Co., Ltd., and average particle size 1 μm) | 19.0 |

(1-2-2) Composition Layer Forming Step

The above described silicone rubber composition was applied to the substrate which was treated with the primer by a ring coating method so that the thickness became 450 μm and the composition layer was formed.

(1-2-3) Low Concentration Region Forming Step

Subsequently, a low concentration region was formed in the obtained composition layer with the use of the corona charger illustrated in FIGS. 2A and 2B.

Here, for a discharge wire 205 that functioned as a discharge electrode which the corona charger had, a tungsten wire was used of which the cross section perpendicular to the wire was a circle with a diameter of 60 μm. In addition, the corona charger had a flat-shaped grid 206 which functioned as a control electrode, on an opening on the side facing the surface of the composition layer, out of the openings formed by the shields 203 and 204. The grid 206 was arranged between the discharge wire 205 and the composition layer, and the amount of an electric current flowing toward the surface of the composition layer was controlled by a charging bias being applied from a high voltage power supply. At this time, the closest distance between the surface of the composition layer and the grid was set at 4.0±0.5 mm.

For a base material of the grid 206, an etching grid was used in which a large number of openings were formed by etching in a thin sheet like metal plate made of austenitic stainless steel (SUS 304, hereinafter described as SUS) and had a thickness of approximately 0.03 mm.

The corona charger described above was arranged opposite to the belt having the composition layer provided on the substrate so that the longitudinal direction of the corona charger is in substantially parallel to the direction perpendicular to the circumferential direction of the belt. Then, while the belt was rotated around its central axis regarded as the rotation axis at 100 rpm, the surface of an uncured (pre-cured) composition layer was charged. As for charging conditions, an electric current which was supplied to the discharge wire of the corona charger was a direct current of −150 μA, and a potential of −1400 V was applied to the grid electrode with the use of a high voltage power source for the grid electrode (trade name: Trek MODEL 610D, manufactured by TREK JAPAN). The charging time was set at 60 seconds. As a result of having measured the surface potential of the composition layer during charging, it was confirmed that the surface of the composition layer was charged at −1316 V.

A surface electrometer (trade name: Trek MODEL 344, manufactured by TREK JAPAN) was used for the measurement of the surface potential, and a distance between a probe of the surface electrometer (trade name: Trek MODEL 6000 B-8, manufactured by TREK JAPAN) and the surface of the composition layer was set at 4 mm.

(1-2-4) Curing Step

The belt having the uncured composition layer provided thereon which was charged was heated in an electric furnace at 160° C. for 1 minute, and then was heated in an electric furnace at 200° C. for 30 minutes, and the composition layer was cured; and thereby an endless belt having the elastic layer was obtained.

The thickness of the elastic layer was 450 μm, and the ratio of the total volume of the fillers to the volume of the elastic layer was 43% by volume.

(1-3) Adhesive Layer Forming Step, and Releasing Layer Forming Step

Onto the surface of the elastic layer of the endless belt, an addition-curable type silicone rubber adhesive (trade name: SE1819CV A/B, manufactured by Dow Corning Toray Co., Ltd.) was approximately uniformly applied as an adhesive layer so that the thickness became 20 μm. Next, a fluorocarbon resin tube (trade name: NSE, manufactured by GUNZE LIMITED) with an inner diameter of 52 mm and a thickness of 40 μm was laminated on the adhesive as a releasing layer, while the diameter was expanded. After that, an excessive adhesive was removed from between the elastic layer and the fluorocarbon resin tube, and an adhesive layer with a thickness of 5 μm was formed.

The obtained endless belt was heated in an electric furnace set at 200° C. for 1 hour, thereby the adhesive layer was cured, and the fluorocarbon resin tube was fixed on the elastic layer. Both ends of the obtained endless belt were cut, and a fixing belt was obtained of which the width was 368 mm.

(2) Evaluation 1 of Fixing Belt (2-1) Thermal Conductivity of Elastic Layer

The thermal conductivity X of the elastic layer which the fixing belt had was calculated from the following expression.

$$\lambda=\alpha\times C_p\times\rho$$

In the expression, X represents the thermal conductivity of the elastic layer (W/(m·K)), a represents thermal diffusivity ($m^2/s$), $C_p$ represents specific heat at constant pressure (J/(kg·K)), and p represents density ($kg/m^3$).

Here, the values of the thermal diffusivity α, the specific heat at constant pressure $C_p$, and the density ρ were determined by the following methods.

Thermal Diffusivity α

The thermal diffusivity α of the elastic layer was measured at room temperature (25° C.) with the use of a periodic heating method thermophysical property measuring apparatus (trade name: FTC-1, manufactured by ADVANCE RIKO, Inc.). As for samples for measurement, a sample piece of which the area was 8×12 mm was cut from an arbitrary portion of the elastic layer with a cutter, and five sample pieces in total were prepared. Then, the thickness (thickness of elastic layer) of each sample piece was measured with the use of a digital measuring device (trade name: DIGIMICROMF-501 flat probe ϕ (diameter) 4 mm, manufactured by NIKON CORPORATION). Next, the thermal diffusivity in the thickness direction was measured 25 times in total of 5 times for each of the sample pieces, and the average value ($m^2/s$) was determined and was defined to be the thermal diffusivity $\alpha$ in the thickness direction of the elastic layer. The measurement was performed while the sample piece was pressed with the use of a 1 kg weight.

As a result, the thermal diffusivity $\alpha$ of the elastic layer was $6.87\times10^{-7}$ $m^2/s$.

Specific Heat at Constant Pressure $C_P$

The specific heat at constant pressure of the elastic layer was measured with the use of a differential scanning calorimeter (trade name: DSC823e, manufactured by Mettler Toledo).

Specifically, aluminum pans were used for a pan for the sample, and a pan for reference. First, as a blank measurement, the measurement was carried out by a program in which both pans were kept at a fixed temperature of 15° C. for 10 minutes in a state of being empty, and then the temperatures were raised to 215° C. at a rate of temperature rise of 10° C./min, and were kept at a fixed temperature of 215° C. for 10 minutes. Next, 10 mg of synthetic sapphire of which the specific heat at constant pressure was known was used as a reference substance, and was subjected to the measurement of the same program. Next, a measurement sample in the same amount of 10 mg as that of the reference sapphire was cut out from an arbitrary portion of the elastic layer, then was set in the sample pan, and was subjected to the measurement of the same program, five times. These measurement results were analyzed with the use of a specific thermal analysis software attached to the above described differential scanning calorimeter, and the specific heat at constant pressure CP at 25° C. was calculated from the average value of the five measurement results.

As a result, the specific heat at constant pressure $C_p$ of the elastic layer was 1.13 J/(g·K).

Density $\rho$

The density of the elastic layer was measured with the use of a dry-type automatic densitometer (trade name: AccuPic 1330-01, manufactured by SHIMADZU CORPORATION). Specifically, a sample cell of 10 $cm^3$ was used, a sample was cut out from an arbitrary portion of the elastic layer so as to satisfy approximately 80% of the cell volume, the mass of the sample was measured, and the sample was placed in the sample cell.

This sample cell was set in a measurement part in the apparatus, helium was used as a gas for measurement, gas purging was performed, and then the volume was measured. The density of the sample was calculated from the mass of the sample and the measured volume. This measurement was repeated regarding other 9 samples cut out from different portions of the elastic layer, and the average value was determined.

As a result, the density $\rho$ of the elastic layer was 2.06 $g/cm^3$.

The thermal conductivity $\lambda$ in the thickness direction of the elastic layer was calculated from the specific heat at constant pressure $C_p$ (J/(kg·K)) and density $\rho$ ($kg/m^3$) of the elastic layer, of which the units were converted, and from the measured thermal diffusivity $\alpha$ ($m^2/s$); and as a result, the thermal conductivity $\lambda$ was 1.60 W/(m·K).

(2-2) Average Value of Ratio of Element Derived from Filler in Substrate Side Region The measurement samples in each of which the length was 5 mm, the width was 5 mm and the thickness was the total thickness of the fixing belt were cut from arbitrary 20 portions in the circumferential direction of the obtained fixing belt. The positions of the collection portions of the measurement samples in the width direction of the fixing belt were determined to be the same.

For each of the twenty measurement samples, a cross section in the circumferential direction of the fixing belt, in other words, a cross section containing a first cross section 1001-1 in the thickness direction and the circumferential direction of the elastic layer was irradiated with an ion beam at an application voltage of 4.5 V in the argon gas atmosphere for 11 hours, with the use of a cross section polisher (trade name: SM09010, manufactured by JEOL Ltd.); and the cross section was polished.

Next, a gold-palladium film was formed on the polished cross section, the surface was thereby made electro-conductive, and a cross section for observation was formed. When the gold-palladium film is formed, the film was coated by sputtering at 30 mA for 20 seconds, with the use of a sputter coater (trade name: 108 auto Sputter Coater; manufactured by Cressington).

The cross section for observation was subjected to secondary electron image observation under conditions of an acceleration voltage of 10 kV, a spot size of 60 μm, an observation magnification of 1000 times, and WD of 8.5 mm, with the use of FE-SEM (trade name: Sigma 500 VP, manufactured by Carl Zeiss Microscopy Co., Ltd). As illustrated in FIG. 3A, an observation portion was adjusted so that the interface (first surface B1) portion between the substrate and the elastic layer of the fixing belt was contained in the visual field, in the lower part of the screen, and an SEM image to be used for EDS analysis was settled.

Subsequently, the ratio of the element (magnesium in Example 1) derived from the filler was measured in the substrate side region (corresponding to portion of reference character 2*c*) of the elastic layer. Energy dispersion type X-ray analyzer (EDS) (trade name: X-MAXN80, manufactured by Oxford Instruments plc) was used for the measurement of the element ratio. The method for measuring the ratio of the element derived from the filler in the substrate side region will be described below in detail. Here, 50 measurement portions were arbitrarily selected on the cross section of the same circumferential direction of the manufactured fixing belt (in other words, the positions in the axial direction were determined to be the same).

First, the obtained SEM image was regarded as an EDS analysis region, and the image was captured. Then, ratios of the element derived from the filler in elastic layer portions were measured that corresponded to 50 portions L1 to L50 as illustrated in FIG. 3B, which were arbitrarily selected in the circumferential direction (right direction of paper face) of the fixing belt, and that contained at least a substrate side region having a thickness up to 6 μm from the first surface B1. Specifically, a range of a distance of 100 μm in a direction toward the releasing layer (upper direction on paper face), which contains at least a region having a thickness of 6 μm corresponding to each portion from the first surface B1 toward the second surface B2, was determined to be an object of the line analysis. The measurement lines which are objects to be analyzed are indicated as arrows in FIG. 3B. As for the analysis conditions, the analysis was carried out in a multi-line analysis mode, and in the collection line data setting of EDS, was carried out with 4 times of scans, a pixel dwell time of 5 ms, a space between pixels (measurement pitch) of 0.1 μm, and 50 lines. Then, in each of the portions L1 to L50, element ratios of magnesium (derived from filler) and nickel (derived from substrate) were obtained at each thickness position from the first surface B1 toward the second surface B2. Then, the measurement results obtained on each of the portions were averaged at each thickness position. Specifically, 50 measurement results in total corresponding to each of the obtained measurement lines in each of the thickness positions were averaged, and an average value (first average value) of the element ratio in each of the thickness positions was obtained. The gold and palladium elements were elements derived from the electro-conducting treatment and were not elements derived from the fixing belt, and accordingly were excluded from the object of the analysis.

Figure 9A:
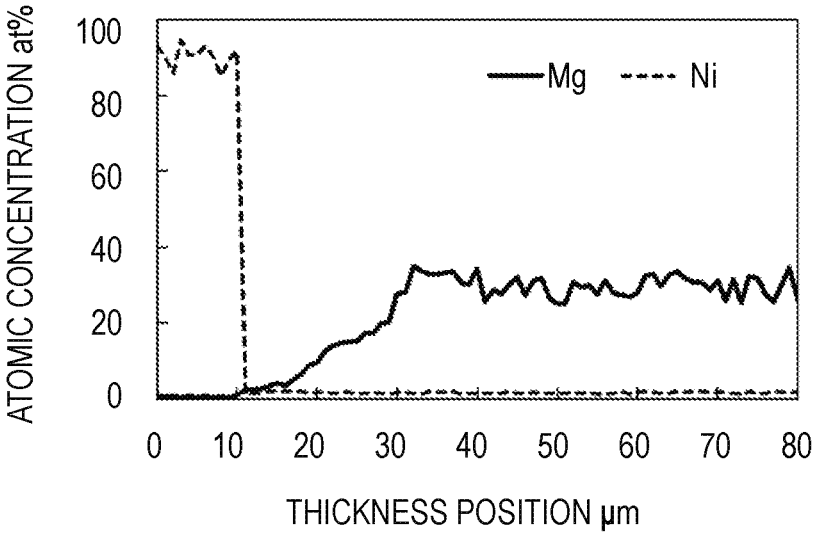
FIG. 9A is a graph illustrating element ratios of an element (Mg) derived from a filler and an element (Ni) of a substrate in the fixing member according to Example 1.

FIG. 9A illustrates the results of atomic concentration distribution when atomic concentration contents of magnesium and nickel corresponding to L1 to L50 which have been obtained from one measurement sample are averaged at each of the thickness positions. Here, the thickness position of 0 μm in FIG. 9A corresponds to the lower end portion of the measurement line (arrow) in a downside of the paper face, which is illustrated in FIG. 3B, and each of the thickness positions represents a distance from the lower end portion.

Referring to FIG. 9A, in the range of 0 to 10 μm of the thickness position, the atomic concentration of nickel derived from the substrate is high, and in the range of 10 μm to 80 μm, though the 10 μm is regarded as a boundary, the atomic concentration of nickel is approximately 0 atomic %. On the other hand, magnesium derived from the filler is approximately 0 atomic % in the thickness position in the range of 0 μm to 10 μm, and shows a high atomic concentration in the range of 10 to 80 μm. From the result, it can be understood that the position at the thickness position of 10 μm corresponds to the position of the first surface B1.

Next, the arithmetic average of the first average value of the element ratios at each of the thickness positions of 20 sets was determined, which were obtained from 20 measurement samples, and the average value (second average value) of the element ratios at each of the thickness positions was obtained. Subsequently, the average ratio of the element ratio of the magnesium in the substrate side region up to the thickness of 6 μm of the elastic layer from the first surface B1 toward the second surface B2 was calculated, with the use of the second average value of the element ratio at each of the thickness positions. More specifically, the space between pixels (measurement pitch) on the EDS line was set at 0.1 μm, in the above described collection line data setting of EDS, and accordingly in the range up to the thickness of 6 μm from the first surface B1, 60 (number of data=6 μm/0.1 μm) measurement data existed which were obtained by averaging the results of each of the measurement lines. Therefore, the average value of the element ratios of magnesium in the substrate side region, which was calculated by further averaging the 60 data was 2.1 atomic %, and it was confirmed that the low concentration region 2*c* was formed in the elastic layer.

(3) Evaluation 2 of Fixing Belt

The fixing belt was incorporated into a fixing apparatus of an electrophotographic type copying machine (trade name: image RUNNERADVANCEC 7065, manufactured by Canon Inc.), as a heating belt.

With the use of this copying machine, the fixing belt was subjected to sheet durability evaluation by envelope. After the envelope has been passed, the elastic layer in the boundary portion of the heating belt (reference character W1 shown in FIG. 6B) between the sheet-passing portion and the non-sheet-passing portion of the envelope was peeled off from the substrate; and the scratch on the substrate was evaluated.

The criteria of the evaluation results are as follows.

Rank A: the depth of the scratch is less than 1 μm.

Rank B: the depth of the scratch is 1 μm or more to less than 5 μm.

Rank C: the depth of the scratch is 5 μm or more.

Examples 2 to 4

Fixing belts of Examples 2 to 4 were manufactured similarly to that of Example 1, except that charging (treatment) time was changed in the low concentration region forming step as shown in the following Table 3, and were subjected to Evaluation 1 and Evaluation 2.

Comparative Example 1

Figure 9B:
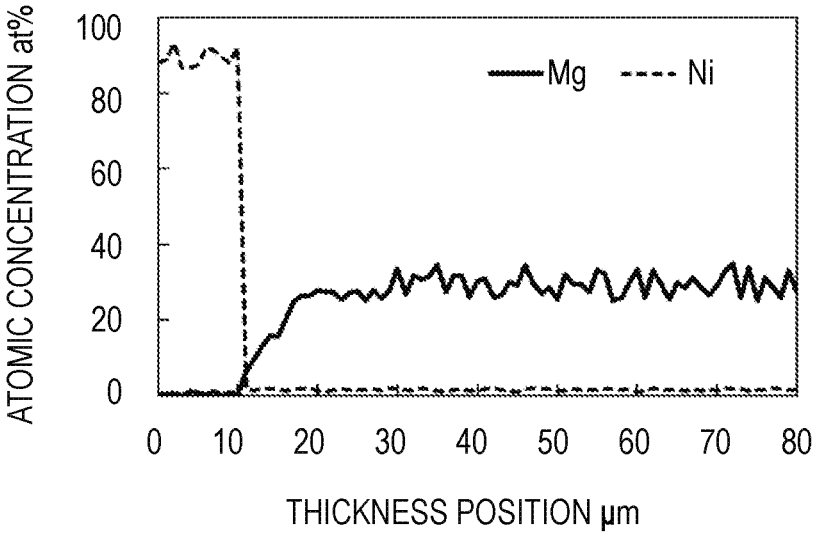
FIG. 9B is a graph illustrating element ratios of the element (Mg) derived from a filler and an element (Ni) of a substrate in the fixing member according to Comparative Example 1.

A fixing belt was manufactured similarly to that of Example 1, except that the low concentration region forming step was not provided, and was subjected to Evaluation 1 and Evaluation 2. FIG. 9B illustrates the result of the atomic concentration distribution at the time when the atomic concentration distributions (unillustrated) of magnesium and nickel corresponding to portions L1 to L50 were averaged at each of the thickness positions, which were obtained by the method of calculating the average value of the ratios of the element derived from the filler.

Comparative Example 2

A fixing belt was manufactured similarly to that of Comparative Example 1, except that an amount of filler (MgO (A)) blended into the silicone rubber composition was changed as shown in the following Table 3, and was subjected to Evaluation 1 and Evaluation 2.

Examples 5 to 9

Fixing belts were manufactured similarly to that of Example 1, except that the type and the amount of the filler blended into a silicone rubber composition were changed as shown in the following Table 3.

Example 10

A fixing belt was manufactured similarly to that of Example 1, except that the applied voltage was set at −950 V in the low concentration region forming step as shown in the following Table 3, and was subjected to Evaluation 1 and Evaluation 2.

Example 11

A fixing belt was manufactured similarly to that of Example 1, except that the thickness of the composition layer was changed to 200 μm in the composition layer forming step as shown in the following Table 3, and was subjected to Evaluation 1 and Evaluation 2.

Example 12

A fixing belt was manufactured similarly to that of Example 1, except that a polarity of the voltage applied to the grid and the discharge wire was changed to a positive in the low concentration region forming step as shown in the following Table 3, and was subjected to Evaluation 1 and Evaluation 2.

Examples 13 to 17

Fixing belts were manufactured similarly to that of Example 1, except that the type and the amount of the blended filler were changed as shown in the following Table 3, and were subjected to Evaluation 1 and Evaluation 2. In Examples 13 to 17, the following thermally conductive fillers were used, respectively.

Example 13: alumina (trade name: Low Soda Alumina AL-43KT, manufactured by Showa Denko K.K.)

Example 14: zinc oxide (trade name: LPZINC-11, manufactured by Sakai Chemical Industry Co., Ltd.)

Example 15: titanium oxide (trade name: JR-1000, manufactured by TAYCA CORPORATION)

Example 16: aluminum nitride (trade name: ALN 100SF, manufactured by Thrutek Applied Materials Co., Ltd.)

Example 17: boron nitride (trade name: Shobi N UHP-2, manufactured by Showa Denko K.K.)

The evaluation results of the fixing belts according to Examples 1 to 17 and Comparative Examples 1 and 2 are shown in Table 3.

TABLE 3

| | | Silicone rubber composition Filler | | | | | | |
|---|---|---|---|---|---|---|---|---|
| | | Type | Average particle size μm | Amount blended % by volume | Type | Average particle size μm | Amount blended % by volume | Composition layer Thickness μm |
| Example | 1 | MgO(A) | 10 | 40 | MgO(B) | 1 | 3 | 450 |
| | 2 | MgO(A) | 10 | 40 | MgO(B) | 1 | 3 | 450 |
| | 3 | MgO(A) | 10 | 40 | MgO(B) | 1 | 3 | 450 |
| | 4 | MgO(A) | 10 | 40 | MgO(B) | 1 | 3 | 450 |
| | 5 | MgO(A) | 10 | 30 | — | — | — | 450 |
| | 6 | MgO(A) | 10 | 40 | — | — | — | 450 |
| | 7 | MgO(A) | 10 | 43 | — | — | — | 450 |
| | 8 | MgO(A) | 10 | 50 | — | — | — | 450 |
| | 9 | MgO(A) | 10 | 55 | — | — | — | 450 |
| | 10 | MgO(A) | 10 | 40 | MgO(B) | 1 | 3 | 450 |
| | 11 | MgO(A) | 10 | 40 | MgO(B) | 1 | 3 | 200 |
| | 12 | MgO(A) | 10 | 40 | MgO(B) | 1 | 3 | 450 |
| | 13 | Alumina | 5 | 43 | — | — | — | 450 |
| | 14 | Zinc oxide | 11 | 43 | — | — | — | 450 |
| | 15 | Titanium oxide | 1 | 43 | — | — | — | 450 |
| | 16 | AlN | 10 | 43 | — | — | — | 450 |
| | 17 | Boron Nitride | 11 | 43 | — | — | — | 450 |
| Comparative | 1 | MgO(A) | 10 | 40 | MgO(B) | 1 | 3 | 450 |
| Example | 2 | MgO(A) | 10 | 25 | MgO(B) | 1 | 3 | 450 |

| | | Treatment conditions | | | Elastic layer | | Rating |
|---|---|---|---|---|---|---|---|
| | | Applied voltage V | Charging time Seconds | Surface potential V | Thermal conductivity W/(m · K) | Substrate side region Element ratio Atomic % | Scratch level after envelope passing |
| Example | 1 | −1400 | 60 | −1316 | 1.60 | 2.1 | A |
| | 2 | −1400 | 30 | −1316 | 1.61 | 2.2 | A |
| | 3 | −1400 | 10 | −1316 | 1.59 | 3.1 | A |
| | 4 | −1400 | 5 | −1316 | 1.60 | 6.0 | B |
| | 5 | −1400 | 60 | −1302 | 1.00 | 1.8 | A |
| | 6 | −1400 | 60 | −1316 | 1.37 | 2.0 | A |
| | 7 | −1400 | 60 | −1320 | 1.43 | 2.1 | A |
| | 8 | −1400 | 60 | −1330 | 1.75 | 2.3 | A |
| | 9 | −1400 | 60 | −1337 | 2.05 | 3.5 | B |
| | 10 | −950 | 60 | −893 | 1.40 | 3.6 | B |
| | 11 | −1400 | 60 | −1176 | 1.35 | 3.5 | B |
| | 12 | 1400 | 60 | 1316 | 1.35 | 3.5 | B |
| | 13 | −1400 | 60 | −1180 | 1.11 | 2.1 | A |
| | 14 | −1400 | 60 | −794 | 1.10 | 5.1 | B |
| | 15 | −1400 | 60 | −1223 | 0.82 | 2.2 | A |
| | 16 | −1400 | 60 | −1124 | 1.65 | 3.6 | B |
| | 17 | −1400 | 60 | −1090 | 1.72 | 4.1 | B |
| Comparative | 1 | — | 0 | — | 1.20 | 12.2 | C |
| Example | 2 | — | 0 | — | 0.97 | 11.5 | C |

Example 18

In the low concentration region forming step, the voltage was not applied to the grid and the discharge wire, and the rotation time of the belt was set at 3600 seconds. In addition, the low concentration region was formed by moving alumina of which the specific gravity is larger than the addition-curable type liquid silicone rubber to the outer surface side of the composition layer, with the use of a centrifugal force at the time of the rotation. A fixing belt was manufactured similarly to that of Example 13, except that such a low concentration region forming step was used, and was subjected to Evaluation 1 and Evaluation 2.

Example 19

In the low concentration region forming step, the voltage was not applied to the grid and the discharge wire, and furthermore, the rotation frequency of the belt was set at 500 rpm, and the rotation time was set at 600 seconds. In addition, the low concentration region was formed by moving zinc oxide of which the specific gravity is larger than the addition-curable type liquid silicone rubber to the outer surface side of a composition layer, with the use of the centrifugal force at the time of the rotation. A fixing belt was manufactured similarly to that of Example 14, except that such a low concentration region forming step was used, and was subjected to Evaluation 1 and Evaluation 2.

The evaluation results of the fixing belts according to Examples 18 and 19 are shown in Table 4.

TABLE 4

| | | Silicone rubber composition Filler | | | | | | | Treatment conditions | | Elastic layer | | | |
|---|---|---|---|---|---|---|---|---|---|---|---|---|---|---|
| | | Type | Average particle size μm | Amount blended % by volume | Type | Average particle size μm | Amount blended % by volume | Composition layer Thickness μm | Rotational frequency rpm | Treatment time Seconds | Thermal conductivity W/(m · K) | Substrate side region Element ratio Atomic % | Rating Scratch level after envelope passing |
| Example | 18 | Alumina | 5 | 43 | — | — | — | 450 | 100 | 3600 | 0.95 | 4.8 | B |
| | 19 | Zinc oxide | 11 | 43 | — | — | — | 450 | 500 | 600 | 0.97 | 3.7 | B |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-109688, filed Jun. 7, 2018, which is hereby incorporated by reference herein in its entirety.

What is claimed is:

1. A fixing member comprising a substrate, and a single layer of an elastic layer on the substrate, the elastic layer having a thickness of 100 μm or more, and containing a binder and a filler, wherein the elastic layer contains the filler in a content of 30% by volume or more to 60% by volume or less based on the total volume of the elastic layer, and wherein, when a surface of the elastic layer facing to the substrate is defined as a first surface, and a surface of the elastic layer opposed to the first surface is defined as a second surface, an average value of ratios of an element derived from the filler is 0.0 atomic % or more to 6.0 atomic % or less in a region having a thickness of 6 μm from the first surface toward the second surface.

2. The fixing member according to claim 1, wherein the average value of the ratios of the element derived from the filler in the region is 3.1 atomic % or less.

3. The fixing member according to claim 1, wherein the filler is one selected from the group consisting of alumina, magnesium oxide, zinc oxide, titanium oxide, aluminum nitride and boron nitride.

4. The fixing member according to claim 1, wherein the binder includes a cross-linked silicone rubber.

5. The fixing member according to claim 1, wherein the content of the filler in the elastic layer is 40% by volume or more to 50% by volume or less.

6. The fixing member according to claim 1, wherein the fixing member is a fixing belt that has a substrate in an endless belt shape as the substrate, and in which the elastic layer is arranged on an outer circumferential surface of the substrate in the endless belt shape.

7. The fixing member according to claim 6, wherein a thickness of the substrate is 15 to 80 μm.

8. The fixing member according to claim 6, wherein a thickness of the elastic layer is 200 to 600 μm.

9. A heat fixing apparatus comprising a heating member and a pressing member which is arranged so as to face the heating member, wherein the heating member has a substrate, and a single layer of an elastic layer on the substrate, the elastic layer has a thickness of 100 μm or more, and also contains a binder and a filler, the elastic layer contains the filler in a content of 30% by volume or more to 60% by volume or less based on the total volume of the elastic layer, and wherein, when a surface of the elastic layer facing to the substrate is defined as a first surface, and a surface of the elastic layer opposed to the first surface is defined as a second surface, an average value of ratios of an element derived from the filler is 0.0 atomic % or more to 6.0 atomic % or less in a region having a thickness of 6 μm of the elastic layer, from the first surface toward the second surface.

10. The heat fixing apparatus according to claim 9, further comprising a heating unit for the substrate.

11. The heat fixing apparatus according to claim 10, wherein the heating unit is an induction heating unit, and is a member that can heat by induction heating.

12. The heat fixing apparatus according to claim 11, wherein the substrate includes at least one selected from the group consisting of nickel, iron, copper and aluminum.

13. The heat fixing apparatus according to claim 10, wherein the heating unit is a heater that heats the substrate.

14. The heat fixing apparatus according to claim 13, wherein the heating member has an endless belt shape, and the heater is arranged in contact with an inner circumferential surface of the heating member.

* * * * *